US010231503B2

(12) United States Patent
Greene et al.

(10) Patent No.: US 10,231,503 B2
(45) Date of Patent: Mar. 19, 2019

(54) ARTICLE OF FOOTWEAR HAVING AN UPPER WITH KNITTED ELEMENTS

(71) Applicant: NIKE, Inc., Beaverton, OR (US)

(72) Inventors: Pamela S. Greene, Portland, OR (US); Michael A. Aveni, Lake Oswego, OR (US); Christopher James Lyke, Beaverton, OR (US); Bryan N. Farris, North Plains, OR (US)

(73) Assignee: NIKE, Inc., Beaverton, OR (US)

( * ) Notice: Subject to any disclaimer, the term of this patent is extended or adjusted under 35 U.S.C. 154(b) by 11 days.

(21) Appl. No.: 15/404,635

(22) Filed: Jan. 12, 2017

(65) Prior Publication Data

US 2017/0119084 A1 May 4, 2017

Related U.S. Application Data

(62) Division of application No. 14/033,782, filed on Sep. 23, 2013, now Pat. No. 9,578,919, which is a division (Continued)

(51) Int. Cl.

*A43B 1/04* (2006.01)
*A43B 3/00* (2006.01)

(Continued)

(52) U.S. Cl.

CPC ..... *A43B 1/04* (2013.01); *A43B 3/0031* (2013.01); *A43B 7/20* (2013.01); *A43B 23/025* (2013.01); *A43B 23/0205* (2013.01); *A43B 23/026* (2013.01); *A43B 23/028* (2013.01); *A43B 23/0235* (2013.01); *A43B 23/26* (2013.01);

(Continued)

(58) Field of Classification Search

CPC ..... A43B 1/04; A43B 3/0031; A43B 7/20; A43B 23/0205; A43B 23/28; A43B 23/028

USPC ..... 36/45, 49, 58.6, 69, 71, 72 B, 92, 102, 36/105

See application file for complete search history.

(56) References Cited

U.S. PATENT DOCUMENTS 601,192 A 3/1898 Woodside
1,012,253 A 12/1911 Gerhart (Continued)

FOREIGN PATENT DOCUMENTS

CN 1035043 A 8/1989
CN 1299622 A 6/2001

(Continued)

OTHER PUBLICATIONS

Examination Report of corresponding EP Application No. 13744850.2 dated Nov. 16, 2017, 6 pages.

(Continued)

*Primary Examiner* — Sharon M Prange
(74) *Attorney, Agent, or Firm* — Brinks Gilson & Lione

(57) ABSTRACT

A method of manufacturing a collar element for an article of footwear is disclosed. The method comprises knitting the collar element comprising a tubular structure defining an interior cavity and a plurality of floating yarns within the cavity. The method further comprises securing the collar element to an upper of the article of footwear. A method of manufacturing an upper for an article of footwear having a collar element is also disclosed.

3 Claims, 34 Drawing Sheets

Related U.S. Application Data of application No. 12/574,876, filed on Oct. 7, 2009, now Pat. No. 9,149,086.

(51) Int. Cl.

| | |
|---|---|
| ***A43B 23/02*** | (2006.01) |
| ***A43B 7/20*** | (2006.01) |
| ***A43B 23/26*** | (2006.01) |
| ***D04B 1/22*** | (2006.01) |
| ***D04B 21/20*** | (2006.01) |

(52) U.S. Cl.

CPC ..... *D04B 1/22* (2013.01); *D04B 21/207* (2013.01); *D10B 2403/0241* (2013.01); *D10B 2501/043* (2013.01)

(56) References Cited

U.S. PATENT DOCUMENTS

| | | | |
|---|---|---|---|
| 1,215,198 | A | 2/1917 | Rothstein |
| 1,597,934 | A | 8/1926 | Stimpson |
| 1,888,172 | A | 11/1932 | Joha |
| 1,902,780 | A | 3/1933 | Holden et al. |
| 1,910,251 | A | 5/1933 | Joha |
| 2,001,293 | A | 5/1935 | Wilson |
| 2,047,724 | A | 7/1936 | Zuckerman |
| 2,147,197 | A | 2/1939 | Glidden |
| 2,314,098 | A | 3/1943 | McDonald |
| 2,330,199 | A | 9/1943 | Basch |
| 2,343,390 | A | 3/1944 | Ushakoff |
| 2,400,692 | A | 5/1946 | Herbert |
| 2,440,393 | A | 4/1948 | Clark |
| 2,569,764 | A | 10/1951 | Jonas |
| 2,586,045 | A | 2/1952 | Hoza |
| 2,608,078 | A | 8/1952 | Anderson |
| 2,641,004 | A | 6/1953 | Whiting et al. |
| 2,675,631 | A | 4/1954 | Doughty |
| 2,994,322 | A | 8/1961 | Cullen et al. |
| 3,252,176 | A | 5/1966 | Gropper |
| 3,583,081 | A | 6/1971 | Hayashi |
| 3,694,940 | A | 10/1972 | Stohr |
| 3,704,474 | A | 12/1972 | Winkler |
| 3,766,566 | A | 10/1973 | Tadokoro |
| 3,778,856 | A | 12/1973 | Christie et al. |
| 3,952,427 | A | 4/1976 | von den Benken et al. |
| 3,972,086 | A | 8/1976 | Belli et al. |
| 4,027,402 | A | 6/1977 | Liu et al. |
| 4,031,586 | A | 6/1977 | von den Benken et al. |
| 4,211,806 | A | 7/1980 | Civardi et al. |
| 4,232,458 | A | 11/1980 | Bartels |
| 4,255,949 | A | 3/1981 | Thorneburg |
| 4,258,480 | A | 3/1981 | Famolare, Jr. |
| 4,317,292 | A | 3/1982 | Melton |
| 4,373,361 | A | 2/1983 | Thorneburg |
| 4,447,967 | A | 5/1984 | Zaino |
| 4,465,448 | A | 8/1984 | Aldridge |
| 4,607,439 | A | 8/1986 | Sogabe et al. |
| 4,704,808 | A | 11/1987 | Blanchini |
| 4,737,396 | A | 4/1988 | Kamat |
| 4,750,339 | A | 6/1988 | Simpson, Jr. et al. |
| 4,756,098 | A | 7/1988 | Boggia |
| 4,785,558 | A | 11/1988 | Shiomura |
| 4,813,158 | A | 3/1989 | Brown |
| 4,852,275 | A | 8/1989 | Bianchini et al. |
| 5,031,423 | A | 7/1991 | Ikenaga |
| 5,095,720 | A | 3/1992 | Tibbals, Jr. |
| 5,117,567 | A | 6/1992 | Berger |
| 5,152,025 | A | 10/1992 | Hirmas |
| 5,192,601 | A | 3/1993 | Neisler |
| 5,345,638 | A | 9/1994 | Nishida |
| 5,353,524 | A | 10/1994 | Brier |
| 5,365,677 | A | 11/1994 | Dalhgren |
| 5,371,957 | A | 12/1994 | Gaudio |
| 5,461,884 | A | 10/1995 | Depoe et al. |
| 5,511,323 | A | 4/1996 | Dahlgren |
| 5,572,860 | A | 11/1996 | Mitsumoto et al. |
| 5,575,090 | A | 11/1996 | Condini |
| 5,623,840 | A | 4/1997 | Roell |
| 5,678,325 | A | 10/1997 | Davidowitz et al. |
| 5,729,918 | A | 3/1998 | Smets |
| 5,735,145 | A | 4/1998 | Pernick |
| 5,746,013 | A | 5/1998 | Fay, Sr. |
| 5,765,296 | A | 6/1998 | Ludemann et al. |
| 5,884,419 | A | 3/1999 | Davidowitz et al. |
| 5,946,825 | A | 9/1999 | Koh et al. |
| 5,996,189 | A | 12/1999 | Wang |
| 6,029,376 | A | 2/2000 | Cass |
| 6,032,387 | A | 3/2000 | Johnson |
| 6,052,921 | A | 4/2000 | Oreck |
| 6,088,936 | A | 7/2000 | Bahl |
| 6,094,841 | A | 8/2000 | Adams |
| 6,151,802 | A | 11/2000 | Reynolds |
| 6,170,175 | B1 | 1/2001 | Funk |
| 6,308,438 | B1 | 10/2001 | Throneburg et al. |
| 6,333,105 | B1 | 12/2001 | Tanaka et al. |
| 6,401,364 | B1 | 6/2002 | Burt |
| 6,558,784 | B1 | 5/2003 | Norton et al. |
| 6,588,237 | B2 | 7/2003 | Cole et al. |
| 6,754,983 | B2 | 6/2004 | Hatfield et al. |
| 6,910,288 | B2 | 6/2005 | Dua |
| 6,922,917 | B2 | 8/2005 | Kerns et al. |
| 6,931,762 | B1 | 8/2005 | Dua |
| 6,981,392 | B2 | 1/2006 | Miyai |
| D517,297 | S | 3/2006 | Jones et al. |
| 7,051,460 | B2 | 5/2006 | Orei et al. |
| 7,056,402 | B2 | 6/2006 | Koerwien et al. |
| 7,347,011 | B2 | 3/2008 | Dua et al. |
| 7,441,348 | B1 | 10/2008 | Dawson |
| 7,543,397 | B2 | 6/2009 | Kilgore et al. |
| 7,568,298 | B2 | 8/2009 | Kerns |
| 7,682,219 | B2 | 3/2010 | Falla |
| 7,774,956 | B2 | 8/2010 | Dua et al. |
| 7,891,120 | B1 | 2/2011 | Neihoff |
| 8,490,299 | B2 | 7/2013 | Dua et al. |
| 2002/0078599 | A1 | 6/2002 | Delgorgue et al. |
| 2002/0139009 | A1 | 10/2002 | Mark |
| 2002/0148258 | A1 | 10/2002 | Cole et al. |
| 2003/0126762 | A1 | 7/2003 | Tseng |
| 2003/0191427 | A1 | 10/2003 | Jay et al. |
| 2004/0118018 | A1 | 6/2004 | Dua |
| 2004/0181972 | A1 | 9/2004 | Csorba |
| 2005/0081402 | A1 | 4/2005 | Orei et al. |
| 2005/0115284 | A1 | 6/2005 | Dua |
| 2005/0178027 | A1 | 8/2005 | Hernandez Martinez Portillo et al. |
| 2005/0193592 | A1 | 9/2005 | Dua et al. |
| 2005/0235701 | A1 | 10/2005 | Miyai |
| 2005/0273988 | A1 | 12/2005 | Christy |
| 2005/0284000 | A1 | 12/2005 | Kerns |
| 2006/0059715 | A1 | 3/2006 | Aveni |
| 2006/0162187 | A1 | 7/2006 | Byrnes et al. |
| 2007/0022627 | A1 | 2/2007 | Sokolowski et al. |
| 2007/0180730 | A1 | 8/2007 | Greene et al. |
| 2007/0294920 | A1 | 12/2007 | Baychar |
| 2008/0017294 | A1 | 1/2008 | Bailey et al. |
| 2008/0078102 | A1 | 4/2008 | Kilgore et al. |
| 2008/0110048 | A1 | 5/2008 | Dua et al. |
| 2008/0110049 | A1* | 5/2008 | Sokolowski ..... A43B 1/04 36/50.1 |
| 2008/0189830 | A1 | 8/2008 | Egglesfield |
| 2008/0313939 | A1 | 12/2008 | Ardill |
| 2009/0068908 | A1 | 3/2009 | Hinchcliff |
| 2010/0051132 | A1 | 3/2010 | Glenn |
| 2010/0154256 | A1 | 6/2010 | Dua |
| 2010/0170651 | A1 | 7/2010 | Scherb et al. |
| 2011/0030244 | A1 | 2/2011 | Motawi et al. |
| 2011/0078921 | A1 | 4/2011 | Greene et al. |
| 2012/0255201 | A1 | 10/2012 | Little |

FOREIGN PATENT DOCUMENTS

| | | | |
|---|---|---|---|
| CN | 1782156 | A | 6/2006 |
| CN | 100415132 | C | 9/2008 |
| DE | 870963 | | 3/1953 |

(56) References Cited

FOREIGN PATENT DOCUMENTS

| | | | |
|---|---|---|---|
| DE | 1084173 | | 6/1960 |
| DE | 19738433 | A1 | 4/1998 |
| DE | 19728848 | A1 | 1/1999 |
| EP | 0279950 | A2 | 12/1987 |
| EP | 0448714 | B1 | 10/1991 |
| EP | 0728860 | A1 | 8/1996 |
| EP | 0758693 | A1 | 2/1997 |
| EP | 0898002 | A2 | 2/1999 |
| EP | 1233091 | A1 | 8/2002 |
| EP | 1437057 | A1 | 7/2004 |
| EP | 1563752 | A1 | 8/2005 |
| EP | 1602762 | A1 | 12/2005 |
| EP | 1972706 | A1 | 9/2008 |
| FR | 2171172 | | 9/1973 |
| GB | 273968 | | 7/1927 |
| GB | 538865 | | 8/1941 |
| GB | 2018837 | A | 10/1979 |
| GB | 1603487 | | 11/1981 |
| JP | S42-4191 | | 3/1967 |
| JP | S58175706 | U | 11/1983 |
| JP | 61028055 | | 2/1986 |
| JP | 5137603 | | 6/1993 |
| JP | H05228006 | | 7/1993 |
| JP | H06113905 | | 4/1994 |
| JP | H08109553 | | 4/1996 |
| JP | 8131208 | | 5/1996 |
| JP | H11302943 | | 11/1999 |
| JP | 2002-199902 | A | 7/2002 |
| JP | 2004-230151 | | 8/2004 |
| JP | 2006-102051 | A | 4/2006 |
| JP | 2006-511306 | A | 4/2006 |
| JP | 5628929 | B2 | 11/2014 |
| KR | 2020000032174 | Y1 | 1/2001 |
| NL | 7304678 | | 10/1974 |
| WO | WO 90/03744 | A1 | 4/1990 |
| WO | WO 00/32861 | A1 | 6/2000 |
| WO | WO 02/31247 | A1 | 4/2002 |
| WO | WO 2004/060093 | A1 | 7/2004 |
| WO | WO 2010/141315 | A1 | 12/2010 |

OTHER PUBLICATIONS

Office Action for corresponding Sri Lanka Application No. 16639, dated Oct. 3, 2017, 1 page.
Office Action and English translation of Vietnam Application No. 1-2014-03100, dated Oct. 16, 2017, 2 pages.
Office Action and English translation of Vietnam Application No. 1-2014-03100, dated Aug. 30, 2017, 2 pages.
Office Action for corresponding Sri Lanka Application No. 17842, dated Sep. 26, 2017, 5 page.
Office Action and relevant partial summary translation for corresponding Chinese Application No. 201380010127.5, dated Jan. 17, 2018, 16 page.
Office Action and relevant English translation of Chinese Application No. 2015109310686, dated Aug. 17, 2017, 13 pages.
Office Action and English translation of relevant portions of Chinese Application No. 2013800101275, dated Sep. 6, 2017, 16 pages.
Declaration of Dr. Edward C. Frederick from the US Patent and Trademark Office Inter Partes Review of U.S. Pat. No. 7,347,011, 178 pages.
Eberle, et al., Excerpt of Hannelore, Clothing Technology, 3rd edition, Third English ed, Beuth-Verlag GmnH, 2002, pp. 2-3, 83, 3 pages.
Examination Report for European Application No. EP 13744850.2, dated Jul. 14, 2016, 5 pages.
Letter from Bruce Huffa dated Dec. 23, 2013, 71 pages.
International Search Report and Written Opinion for Application No. PCT/US2009/056795, dated Apr. 20, 2010, 16 pages.
International Search Report and Written Opinion for Application No. PCT/2010/051144, dated Jul. 13, 2011, 19 pages.
International Preliminary Report on Patentability for Application No. PCT/2010/051144, dated Apr. 19, 2012, 14 pages.
International Search Report and Written Opinion for Application No. PCT/US2012/028534, dated Oct. 17, 2012, 16 pages.
International Preliminary Report on Patentability for Application No. PCT/US2012/028534, dated Sep. 17, 2013, 8 pages.
International Search Report and Written Opinion in connection with PCT/US2013/026619, dated Oct. 1, 2013, 13 pages.
International Search Report and Written Opinion for Application No. PCT/US2012/028576, dated Oct. 1, 2012, 12 pages.
International Preliminary Report on Patentability for Application No. PCT/US2012/028576, dated Sep. 17, 2013, 7 pages.
International Search Report and Written Opinion in connection with PCT/US2012/028559, dated Oct. 19, 2012, 11 pages.
Office Action and relevant English translation of Chinese Application No. 2015109310686, dated Dec. 9, 2016, 16 pages.
Office Action and relevant English translation of Chinese Application No. 2014103843593, dated Oct. 27, 2016, 8 pages.
Office Action and relevant English translation of Chinese Application No. 2014103843593, dated Apr. 15, 2016, 4 pages.
Office Action and relevant English translation of Chinese Application No. 2014103843593, dated Jul. 29, 2015, 13 pages.
Office Action and English translation of relevant portions of Chinese Application No. 2013800101275, dated Dec. 27, 2016, 14 pages.
Office Action and English translation of relevant portions of Chinese Application No. 2013800101275, dated Apr. 28, 2016, 14 pages.
Office Action and English translation of Chinese Application No. 201080045157.6, dated Jun. 17, 2015, 15 pages.
Office Action and English translation of Chinese Application No. 201080045157.6, dated Sep. 22, 2014, 6 pages.
Examination report for European Application No. EP 10782071.4, dated Nov. 13, 2015, 7 pages.
Office Action and English translation of Japanese Application No. JP 2014-557865, dated May 10, 2016, 5 pages.
Office Action and English translation of Japanese Application No. JP 2014-557865, dated Aug. 13, 2015, 5 pages.
Office Action and English translation of Japanese Application No. 2012-533225, dated May 15, 2014, 7 pages.
Office Action and English translation of Japanese Application No. 2012-533225, dated Oct. 10, 2013, 4 pages.
Notice of Allowance of Patent and English translation of Korean Patent Application No. 10-2014-7025790, dated Jul. 28, 2016, 6 pages.
Office Action and English translation of Korean Patent Application No. 10-2014-7025790, dated Jan. 18, 2016, 11 pages.
Notice of Allowance of Patent and English translation of Korean Patent Application No. 10-2014-708738, dated Jul. 30, 2015, 6 pages.
Office Action and English translation of Korean Patent Application No. 10-2014-7008738, dated Jan. 30, 2015, 8 pages.
Office Action and English translation of Korean Patent Application No. 10-2014-7008738, dated Jul. 1, 2014, 9 pages.
Office Action and English translation of Korean Patent Application No. 10-2012-7010450, dated Feb. 28, 2014, 6 pages.
Office Action and English translation of Korean Patent Application No. 10-2012-7010450, dated Aug. 23, 2013, 6 pages.
Office Action and English translation of ROC (Taiwan) Patent Application No. 102105895, dated Sep. 21, 2016, 5 pages.
Office Action and English translation of ROC (Taiwan) Patent Application No. 102105895, dated Apr. 29, 2015, 15 pages.
Office Action and English translation of ROC (Taiwan) Patent Application No. 102105895, dated Jan. 28, 2015, 25 pages.
Office Action and English translation of Vietnamese Patent Application No. 1-2012-01245, dated Mar. 26, 2015, 2 pages.
Spencer D.J., "A Comprehensive Handbook and Practical Guide," in: Knitting Technology, 3rd Edition, Woodhead Publishing Ltd., 2001, 413 pages.
First Examination Report for Indian Patent Application No. 3106/CHENP/2012 dated Aug. 20, 2018, 6 pages.

* cited by examiner

ARTICLE OF FOOTWEAR HAVING AN UPPER WITH KNITTED ELEMENTS

CROSS-REFERENCE TO RELATED APPLICATIONS

This application is a divisional of U.S. application Ser. No. 14/033,782, entitled "Article Of Footwear Having An Upper With Knitted Elements" filed on Sep. 23, 2013, which is a divisional of U.S. application Ser. No. 12/574,876, entitled "Article Of Footwear Having An Upper With Knitted Elements", filed on Oct. 7, 2009 (now U.S. Pat. No. 9,149,086), the disclosures of which applications are hereby incorporated by reference in their entireties.

BACKGROUND

Conventional articles of footwear generally include two primary elements, an upper and a sole structure. The upper is secured to the sole structure and forms a void on the interior of the footwear for comfortably and securely receiving a foot. The sole structure is secured to a lower area of the upper, thereby being positioned between the upper and the ground. In athletic footwear, for example, the sole structure may include a midsole and an outsole. The midsole often includes a polymer foam material that attenuates ground reaction forces to lessen stresses upon the foot and leg during walking, running, and other ambulatory activities. Additionally, the midsole may include fluid-filled chambers, plates, moderators, or other elements that further attenuate forces, enhance stability, or influence the motions of the foot. The outsole is secured to a lower surface of the midsole and provides a ground-engaging portion of the sole structure formed from a durable and wear-resistant material, usually rubber. The sole structure may also include a sockliner positioned within the void and proximal a lower surface of the foot to enhance footwear comfort.

The upper generally extends over the instep and toe areas of the foot, along the medial and lateral sides of the foot, under the foot, and around the heel area of the foot. In some articles of footwear, such as basketball footwear and boots, the upper may extend upward and around the ankle to provide support or protection for the ankle. Access to the void on the interior of the upper is generally provided by an ankle opening in a heel region of the footwear. A lacing system is often incorporated into the upper to adjust the fit of the upper, thereby permitting entry and removal of the foot from the void within the upper. The lacing system also permits the wearer to modify certain dimensions of the upper, particularly girth, to accommodate feet with varying dimensions. In addition, the upper may include a tongue that extends under the lacing system to enhance adjustability of the footwear, and the upper may incorporate a heel counter to limit movement of the heel.

A variety of material elements (e.g., textiles, polymer foam, polymer sheets, leather, synthetic leather) are conventionally utilized in manufacturing the upper. In athletic footwear, for example, the upper may have multiple layers that each include a variety of joined material elements. As examples, the material elements may be selected to impart stretch-resistance, wear-resistance, flexibility, air-permeability, compressibility, comfort, and moisture-wicking to different areas of the upper. In order to impart the different properties to different areas of the upper, material elements are often cut to desired shapes and then joined together, usually with stitching or adhesive bonding. Moreover, the material elements are often joined in a layered configuration to impart multiple properties to the same areas. As the number and type of material elements incorporated into the upper increases, the time and expense associated with transporting, stocking, cutting, and joining the material elements may also increase. Waste material from cutting and stitching processes also accumulates to a greater degree as the number and type of material elements incorporated into the upper increases. Moreover, uppers with a greater number of material elements may be more difficult to recycle than uppers formed from fewer types and numbers of material elements. By decreasing the number of material elements utilized in the upper, therefore, waste may be decreased while increasing the manufacturing efficiency and recyclability of the upper.

SUMMARY

An article of footwear is disclosed below as having an upper and a sole structure secured to the upper. The upper includes a material layer forming at least a portion of an exterior surface of the upper. The upper also includes a knitted component formed of unitary knit construction. The knitted component may include a compressible area and a flange area. The compressible area forms a portion of the exterior surface and a portion of an opposite interior surface of the upper, and the flange area extends outward from the compressible area. The flange area may be located inward from the material layer, and the flange area may be joined with the material layer.

In some configurations, the upper may include a tongue element having a knitted component formed of unitary knit construction and forming a majority of an exterior of the tongue element. A compressible material may be located within a cavity of the knitted component, and an end of the knitted component may be secured to a throat area of the upper.

In another configuration, the upper may include a collar element having a knitted exterior forming at least a portion of an exterior surface and an interior surface of the upper adjacent to an ankle opening of the upper. A plurality of floating yarns may be located within a cavity of the knitted element. Additionally, the collar element may be formed as a separate component from other portions of the upper and secured to the other portions of the upper.

Various methods may be utilized to form components for an article of footwear. For example, circular knitting and flat knitting processes may be utilized to form various components of unitary knit construction. Following knitting, the components may be incorporated into the article of footwear. Moreover, the knitting processes may be utilized to form both compressible areas and flange areas of some components. For example, floating yarns may be laid-in the compressible area to enhance the compressibility.

In one example, a method of manufacturing a collar element for an article of footwear is disclosed. The method comprises knitting the collar element comprising (a) a tubular structure defining an interior cavity and (b) a plurality of floating yarns within the cavity and securing the collar element to an upper of the article of footwear.

In another example, a method of manufacturing an upper for an article of footwear is disclosed, wherein the upper has an ankle opening that provides access to a void. The method comprises, for example, knitting an upper comprising at least an interior surface and an exterior surface adjacent the ankle opening, knitting the collar element comprising a tubular structure defining an interior cavity having a plurality of floating yarns within the cavity, wherein the collar element is formed of unitary knit construction and is formed as a separate component from other portions of the upper. The method further comprises securing the collar element to at least one of the exterior surface and the interior surface of the upper.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

DETAILED DESCRIPTION

The following discussion and accompanying figures disclose articles of footwear having uppers that includes various knitted elements, such as a tongue and a collar. The articles of footwear are disclosed as having a general configuration suitable for walking or running. Concepts associated with the footwear, including the uppers and the various knitted elements, may also be applied to a variety of other athletic footwear types, including baseball shoes, basketball shoes, cross-training shoes, cycling shoes, football shoes, tennis shoes, soccer shoes, and hiking boots, for example. The concepts may also be applied to footwear types that are generally considered to be non-athletic, including dress shoes, casual shoes, loafers, sandals, and work boots. Accordingly, the concepts disclosed herein relating to the knitted elements and the methods of manufacturing the knitted elements apply to a wide variety of footwear types.

General Footwear Structure

Figure 1:
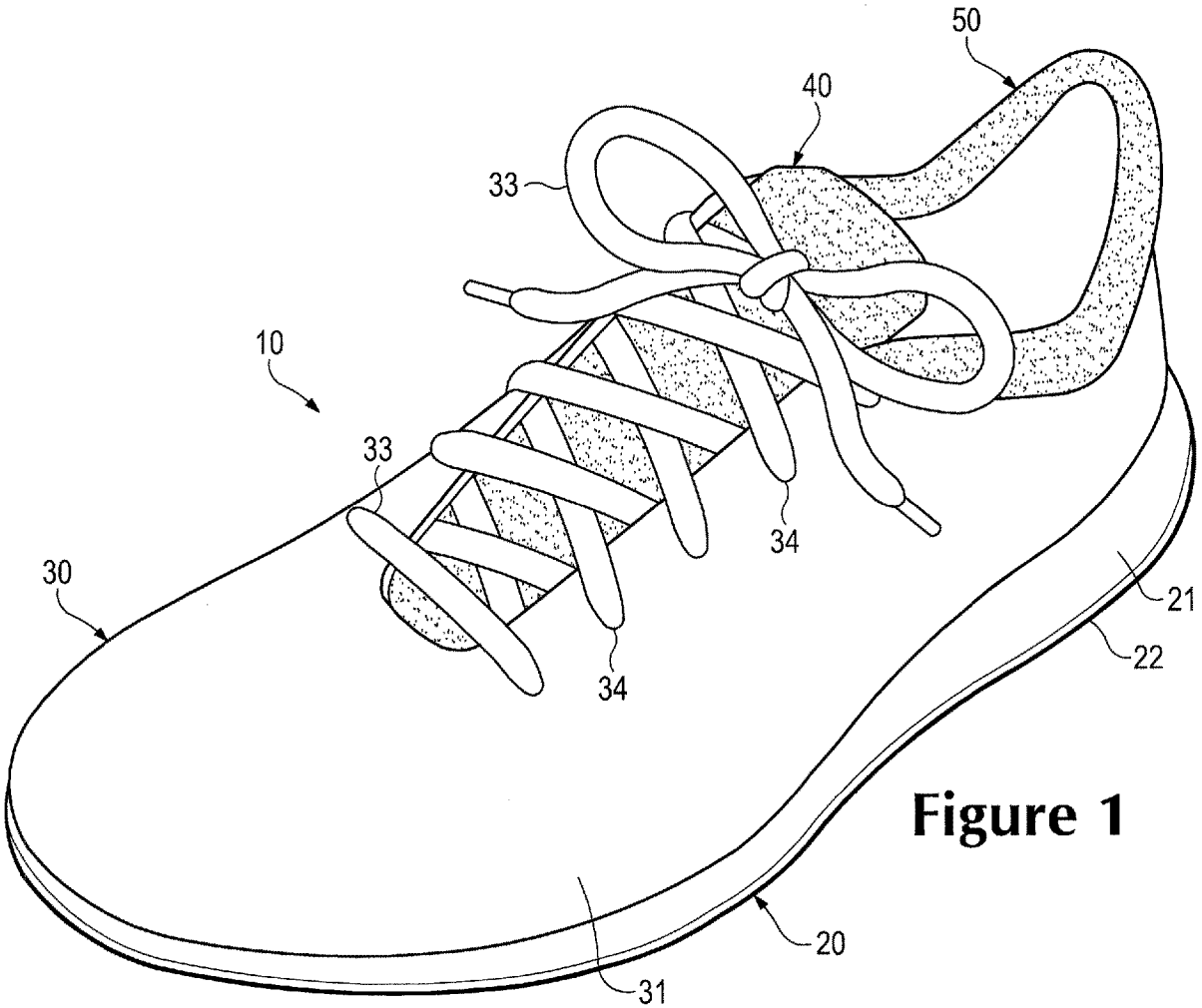
FIG. 1 is a perspective view of an article of footwear.
Figure 2:
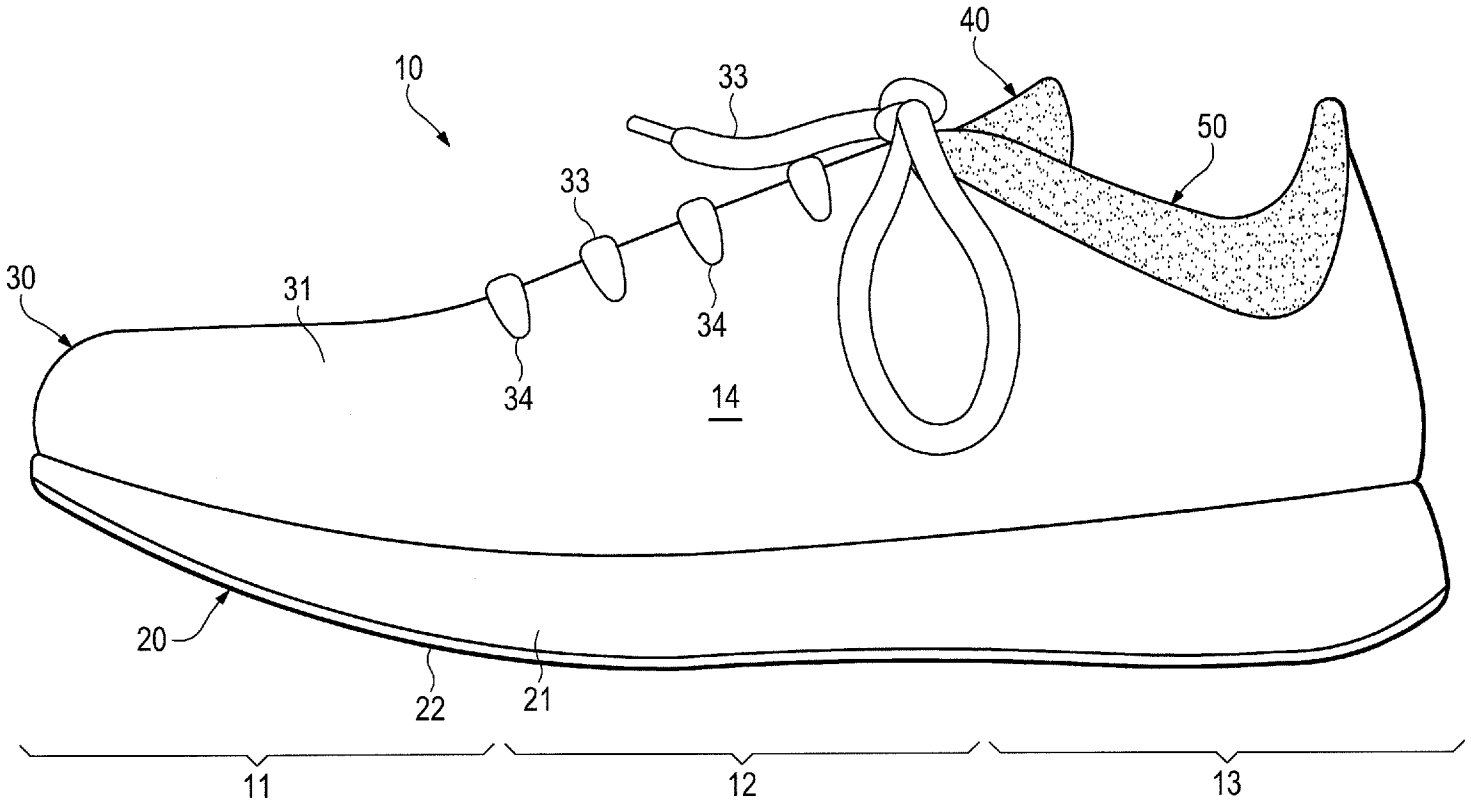
FIG. 2 is a lateral side elevational view of the article of footwear.
Figure 3:
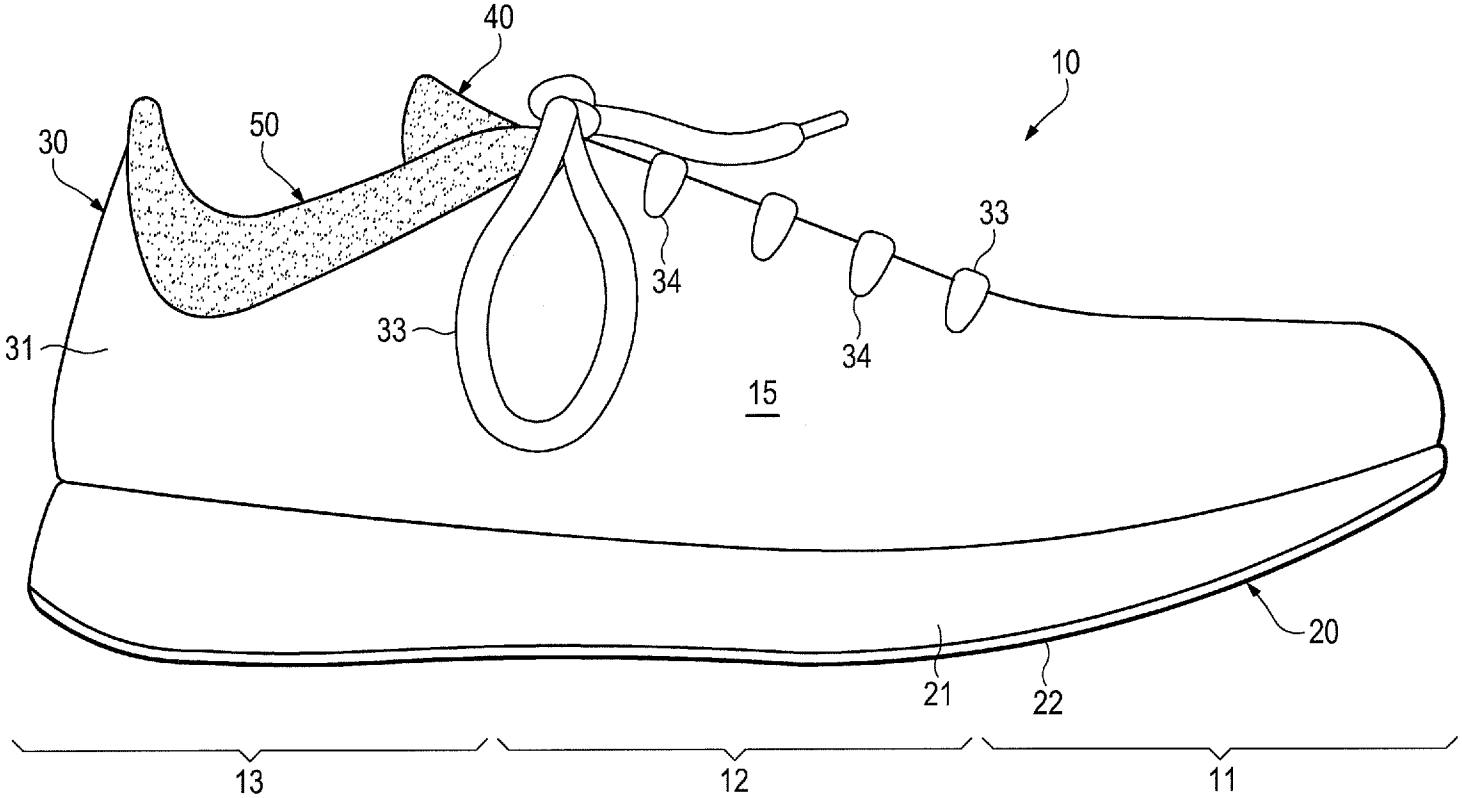
FIG. 3 is a medial side elevational view of the article of footwear
Figure 4:
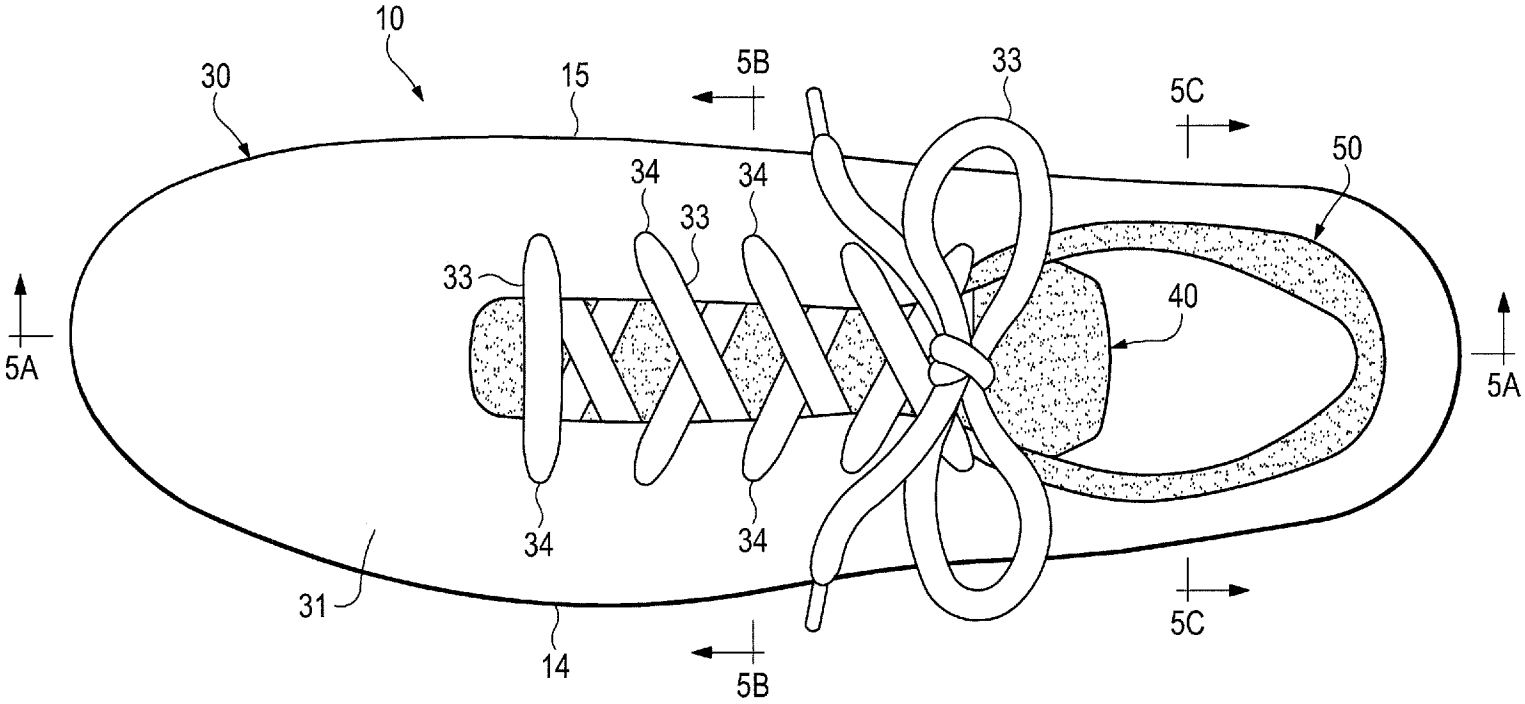
FIG. 4 is a top plan view of the article of footwear.

An article of footwear 10 is depicted in FIGS. 1-5C as including a sole structure 20 and an upper 30. For reference purposes, footwear 10 may be divided into three general regions: a forefoot region 11, a midfoot region 12, and a heel region 13, as shown in FIGS. 2 and 3. Footwear 10 also includes a lateral side 14 and a medial side 15. Forefoot region 11 generally includes portions of footwear 10 corresponding with the toes and the joints connecting the metatarsals with the phalanges. Midfoot region 12 generally includes portions of footwear 10 corresponding with the arch area of the foot, and heel region 13 corresponds with the heel area of the foot, including the calcaneus bone. Lateral side 14 and medial side 15 extend through each of regions 11-13 and correspond with opposite sides of footwear 10. Regions 11-13 and sides 14-15 are not intended to demarcate precise areas of footwear 10. Rather, regions 11-13 and sides 14-15 are intended to represent general areas of footwear 10 to aid in the following discussion. In addition to footwear 10, regions 11-13 and sides 14-15 may also be applied to sole structure 20, upper 30, and individual elements thereof.

Sole structure 20 is secured to upper 30 and extends between the foot and the ground when footwear 10 is worn. The primary elements of sole structure 20 are a midsole 21, an outsole 22, and a sockliner 23. Midsole 21 is secured to a lower area of upper 30 and may be formed from a compressible polymer foam member (e.g., a polyurethane or ethylvinylacetate foam) that attenuates ground reaction forces (i.e., provides cushioning) when compressed between the foot and the ground during walking, running, or other ambulatory activities. In additional configurations, midsole 21 may incorporate fluid-filled chambers, plates, moderators, or other elements that further attenuate forces, enhance stability, or influence motions of the foot, or midsole 21 may be primarily formed from a fluid-filled chamber. Outsole 22 is secured to a lower surface of midsole 21 and may be formed from a wear-resistant rubber material that is textured to impart traction. Sockliner 23 is located within upper 30 and is positioned to extend under a lower surface of the foot. Although this configuration for sole structure 20 provides an example of a sole structure that may be used in connection with upper 30, a variety of other conventional or nonconventional configurations for sole structure 20 may also be utilized. Accordingly, the configuration and features of sole structure 20 or any sole structure utilized with upper 30 may vary considerably.

Figure 5A:
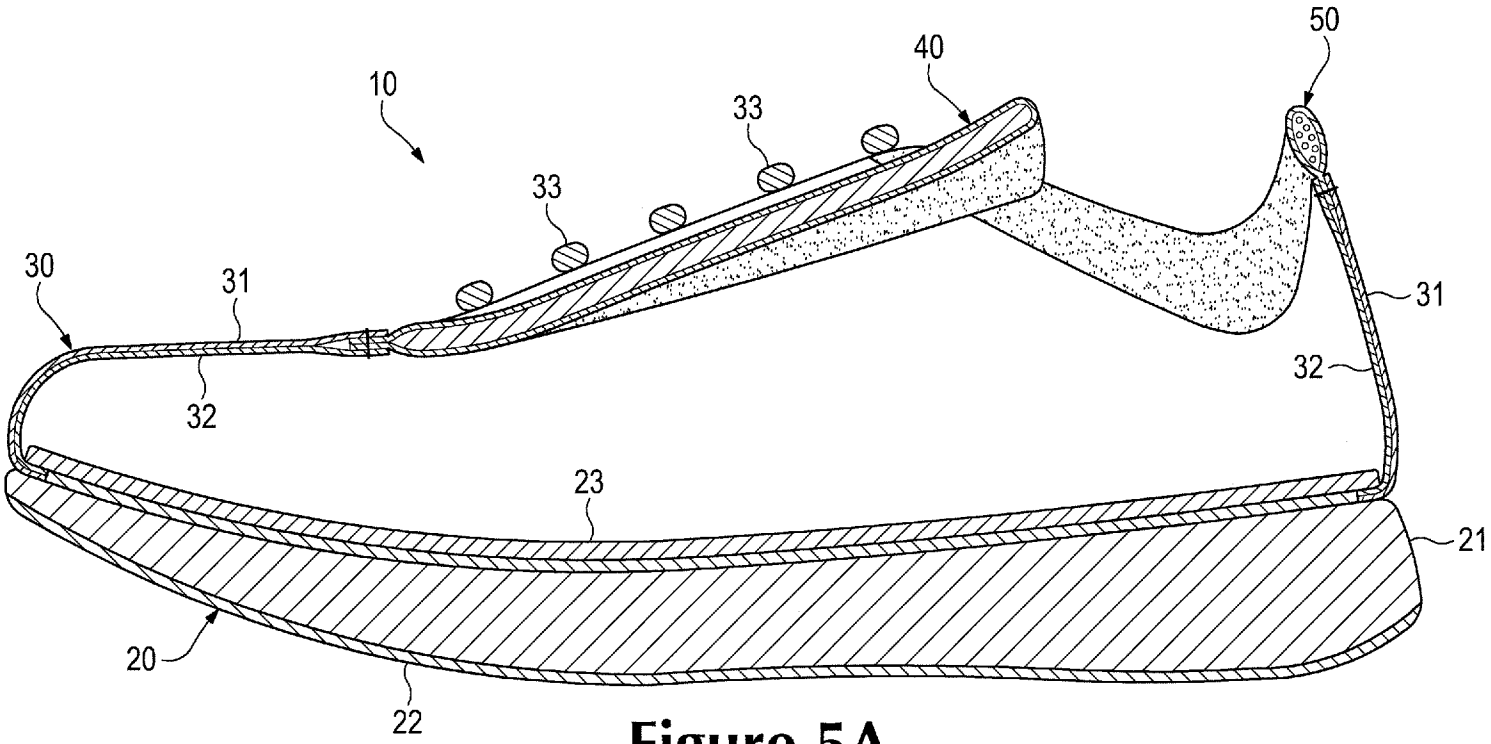
FIGS. 5A-5C are cross-sectional views of the article of footwear, as respectively defined by section lines 5A-5C in FIG. 4.
Figure 5B:
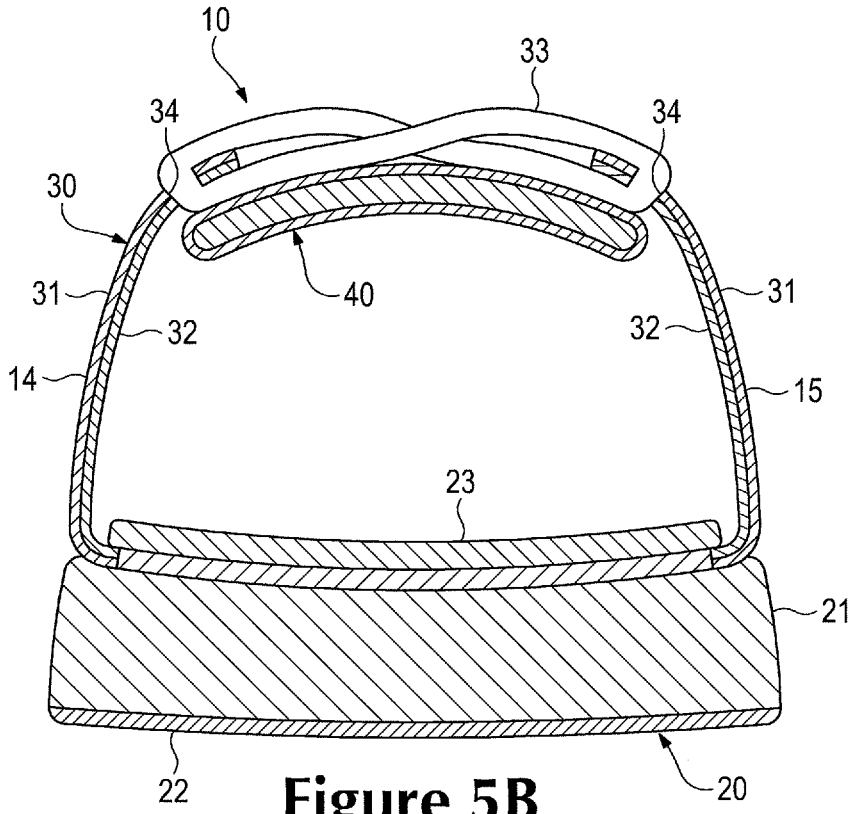
Figure 5C:
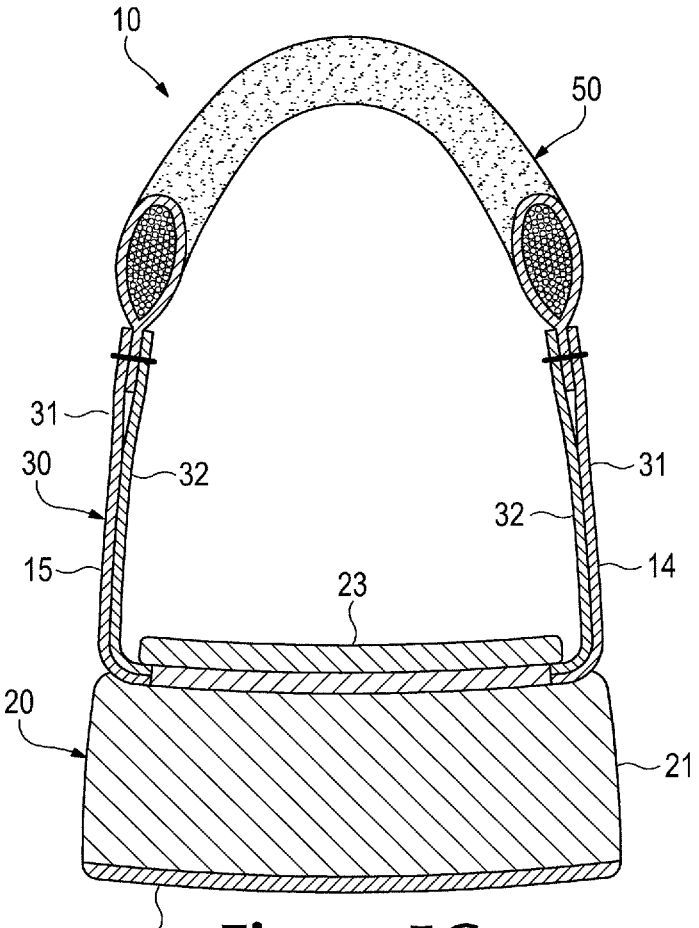

Upper 30 is formed from various elements that combine to provide a structure for securely and comfortably receiving a foot. Although the configuration of upper 30 may vary significantly, the various elements generally define a void within footwear 10 for receiving and securing the foot relative to sole structure 20. Surfaces of the void within upper 30 are shaped to accommodate the foot and extend over the instep and toe areas of the foot, along the medial and lateral sides of the foot, under the foot, and around the heel area of the foot. A portion of upper 30 is formed from various layers 31 and 32, as shown in FIGS. 5A-5C. Whereas layer 31 forms a portion of an exterior surface of upper 30, layer 32 forms a portion of an interior surface of upper 30 (i.e., the surface defining the void within upper 30). Each of layers 31 and 32 may be formed from one or more of a plurality of material elements (e.g., textiles, polymer foam, leather, synthetic leather) that are stitched or bonded together. As an example, layer 31 may be formed from a synthetic leather material and layer 32 may be formed from a moisture-wicking textile material. As another example, each of layers 31 and 32 may be formed from different textile materials. In some configurations, a polymer foam layer may be located between layers 31 and 32 to enhance comfort. In other configurations of upper 30, one-layer, three-layer, or other multi-layer structures formed from a variety of materials may be utilized in place of layers 31 and 32.

A lace 33 extends through various lace apertures 34 and across a throat area of upper 30 to permit the wearer to modify dimensions of upper 30 and accommodate the proportions of the foot. That is, lace 33 operates in a generally conventional manner to tighten upper 30 around the foot (i.e., when lace 33 is tied) and loosen upper 30 (i.e., when lace 33 is untied). A tongue element 40 extends under lace 33 to enhance the comfort and adjustability of footwear 10. Upper 30 also includes a collar element 50 that is located in at least heel region 13. In addition to enhancing the comfort of footwear 10, collar element 50 forms an ankle opening for providing the foot with access to the void within upper 30. That is, the ankle opening defined by collar element 50 facilitates entry and removal of the foot from the void, particularly when lace 33 is untied to impart a loose-fitting configuration to upper 30 around the foot.

Portions of upper 30, including tongue element 40 and collar element 50, may be knitted components formed with a relatively small number of material elements. As discussed in the Background section above, decreasing the number of material elements utilized in an upper may decrease waste, while also increasing the manufacturing efficiency and recyclability of the upper. The tongue and collar of conventional uppers are often formed from multiple joined material elements. As discussed in greater detail below, however, tongue element 40 and collar element 50 may be primarily formed through knitting processes (rather than stitch and turn methods) that decrease waste and increase manufacturing efficiency and recyclability. Additionally, the structures of tongue element 40 and collar element 50 may incorporate lesser numbers of seams or other discontinuities, thereby enhancing the overall comfort of footwear 10.

Tongue Element Configuration

Tongue element 40 is centrally-located in a throat area of upper 30 and extends from forefoot region 11 to heel region 13, as well as from lateral side 14 to medial side 15. Side areas of tongue element 40 are positioned adjacent to and in contact with the areas of layer 32 that form lace apertures 34, and a central area of tongue element 40 is in contact with lace 33 and may be exposed between areas of lace 33 that cross each other. In forefoot region 11, tongue element 40 is joined to layers 31 and 32, but a remainder of tongue element 40 is generally free or unsecured to other areas of upper 30. In heel region 13, tongue element 40 may protrude from the ankle opening formed by collar element 50.

The primary components of tongue element 40, as depicted in FIGS. 6-9B, are a knitted sheath 41 and a compressible core 42. In general, sheath 41 is formed as a knitted element that extends around core 42. More particularly, sheath 41 forms a majority of an exterior of tongue element 40 and also defines an interior cavity in which core 42 is located. Core 42 is a compressible structure within tongue element 40 that enhances the overall comfort of footwear 10. Although core 42 may be formed from polymer foam materials (e.g., polyurethane or ethylvinylacetate foam), core 42 may also be formed from yarns or fluid-filled chambers, for example. In some configurations, tongue element 40 may include additional components, such as (a) logos or trademarks that are screen-printed, stitched, or bonded to sheath 41, (b) lace loops that receive a portion of lace 34 to limit movement of tongue element 40, or (c) care instruction and material placards that are stitched or bonded to sheath 41.

Figure 9A:
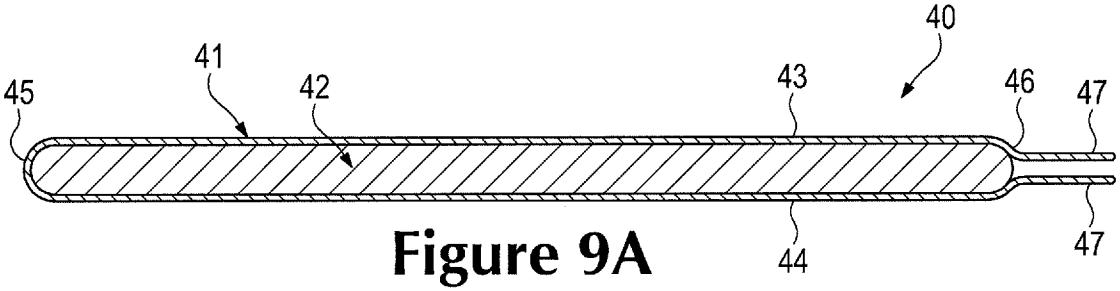
FIGS. 9A and 9B are cross-sectional views of the tongue element, as respectively defined by section lines 9A and 9B in FIG. 8.
Figure 9B:
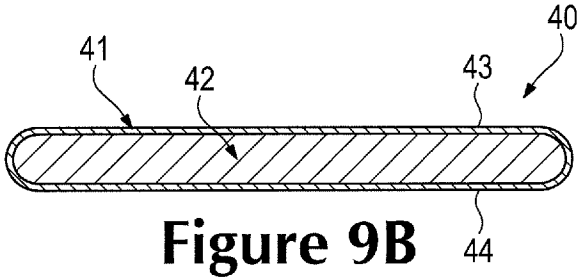

Sheath 41 has a generally tubular structure that forms the cavity in which core 42 is located. In general, sheath 41 includes an upper region 43, a lower region 44, a first end 45, a second end 46, and a pair of flanges 47. Upper region 43 extends over one surface of core 42 and is exposed to the exterior of footwear 10 between the areas of lace 33 that cross each other. Lower region 44, which is positioned opposite upper region 43, extends over another surface of core 42 and forms a portion of the interior surface of upper 30 (i.e., the surface defining the void within upper 30). Referring to FIGS. 9A and 9B, for example, regions 43 and 44 effectively form layers of knitted material located on opposite sides of core 42 and joined to each other, thereby effectively extending around core 42. Whereas first end 45 has a closed configuration, second end 46 forms an opening through which core 42 is inserted into the cavity within sheath 41. Flanges 47 are located at second end 46 and on opposite sides of the opening. Flanges 47 extend outward from tongue element 40 and may be utilized to join tongue element 40 to upper 30. Referring to FIG. 5A, for example, flanges 47 extend between layers 31 and 32 in the throat area of upper 30 and are secured to either or both of layers 31 and 32. Although each of regions 43 and 44 include one of flanges 47, sheath 41 may form only a single flange 47 or both flanges 47 may be absent in some configurations.

Whereas many conventional footwear tongues have a sheath formed from multiple textile elements or other material elements that are joined through stitching or bonding, for example, sheath 41 is formed as a one-piece element through a knitting process, such as circular knitting or flat knitting. More particularly, sheath 41 is generally formed of unitary knit construction through the knitting process. As utilized herein, a knitted component such as sheath 41 is defined as being formed of "unitary knit construction" when constructed as a one-piece knit element that is substantially free of additional stitching or bonding processes. That is, the knitting process substantially forms the various features and structures of sheath 41 without the need for significant additional manufacturing steps or processes. In some configurations, sheath 41 remains formed of unitary knit construction when first end 45 or second end 46 are closed through stitching or bonding in order to seal core 42 within sheath 41, or when areas are trimmed following the knitting process. Additionally, sheath 41 remains formed of unitary knit construction when other minor elements (e.g., logos, trademarks, lace loops, care instruction and material placards) are added to tongue element 40 following the knitting process.

The knitting process utilized to form sheath 41 of unitary knit construction generally involves mechanically-manipulating one or more yarns to form a series of stitches. A variety of different types of yarns may be incorporated into sheath 41 during the knitting process. Polyester, for example, provides relatively high durability and recyclability, and may also impart non-stretch properties depending upon the knit pattern within sheath 41. Cotton provides a soft hand, natural aesthetics, and biodegradability. Elastane and stretch polyester each provide substantial stretch and recoverability, with stretch polyester also providing relatively easy recyclability. Rayon provides high luster and moisture absorption. Wool also provides high moisture absorption, in addition to insulating properties. Nylon is a durable and abrasion-resistant material with relatively high strength. In addition to specific materials, other aspects relating to the yarn may affect the properties of sheath 41 and tongue 40. For example, the yarn may be a monofilament yarn or a multifilament yarn. The yarn may also include separate filaments that are each formed of different materials. The yarn may also include filaments that are each formed of two or more different materials, such as a bicomponent yarn with filaments having a sheath-core configuration or two halves formed of different materials. Different degrees of twist and crimping, as well as different deniers, may affect the properties of sheath 41 and tongue 40. The yarn may also retain an intended shape when formed from materials that are susceptible to heat set. Accordingly, various types of yarn may be incorporated into sheath 41 depending upon the desired properties for sheath 41 and tongue 40.

Tongue element 40 provides various advantages over conventional footwear tongues. For example, tongue element 40 enhances footwear comfort by incorporating few seams or other discontinuities in areas that contact the foot. As another example, tongue element 40 includes relatively few material elements. As discussed in the Background section above, by decreasing the number of material elements utilized in the upper, waste may be decreased while increasing the manufacturing efficiency and recyclability of the upper. To further enhance efficiency, forming sheath 41 through a knitting process limits the number of cutting operations or other processes that generally generate waste material, while allowing the creation of contours that are relatively difficult with stitch and turn methods.

Further Tongue Element Configurations

Figures 10A, 10B, 10C:
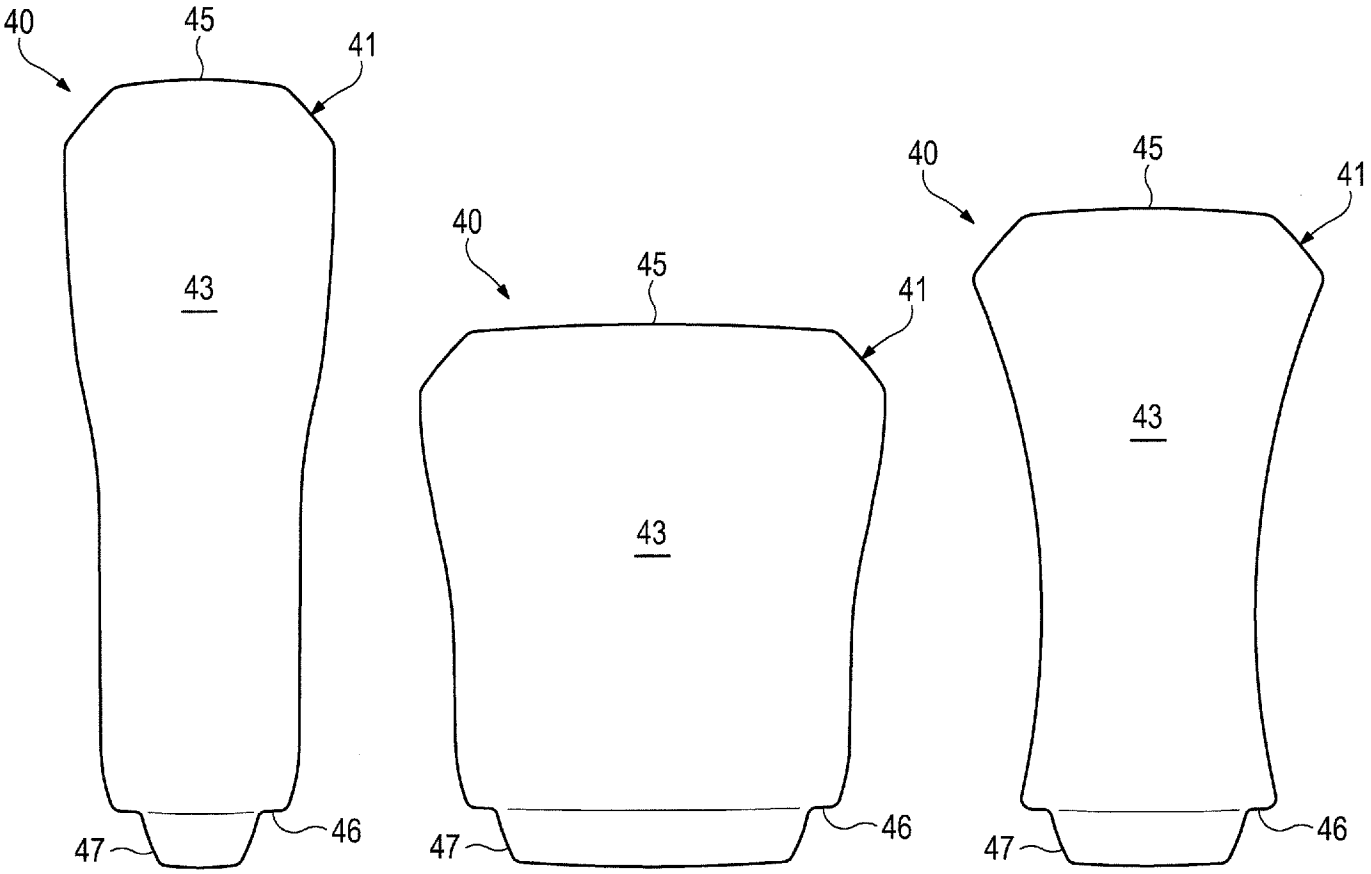
FIGS. 10A-10J are plan views corresponding with FIG. 8 and depicting further configurations of the tongue element.
Figures 10D, 10E, 10F:
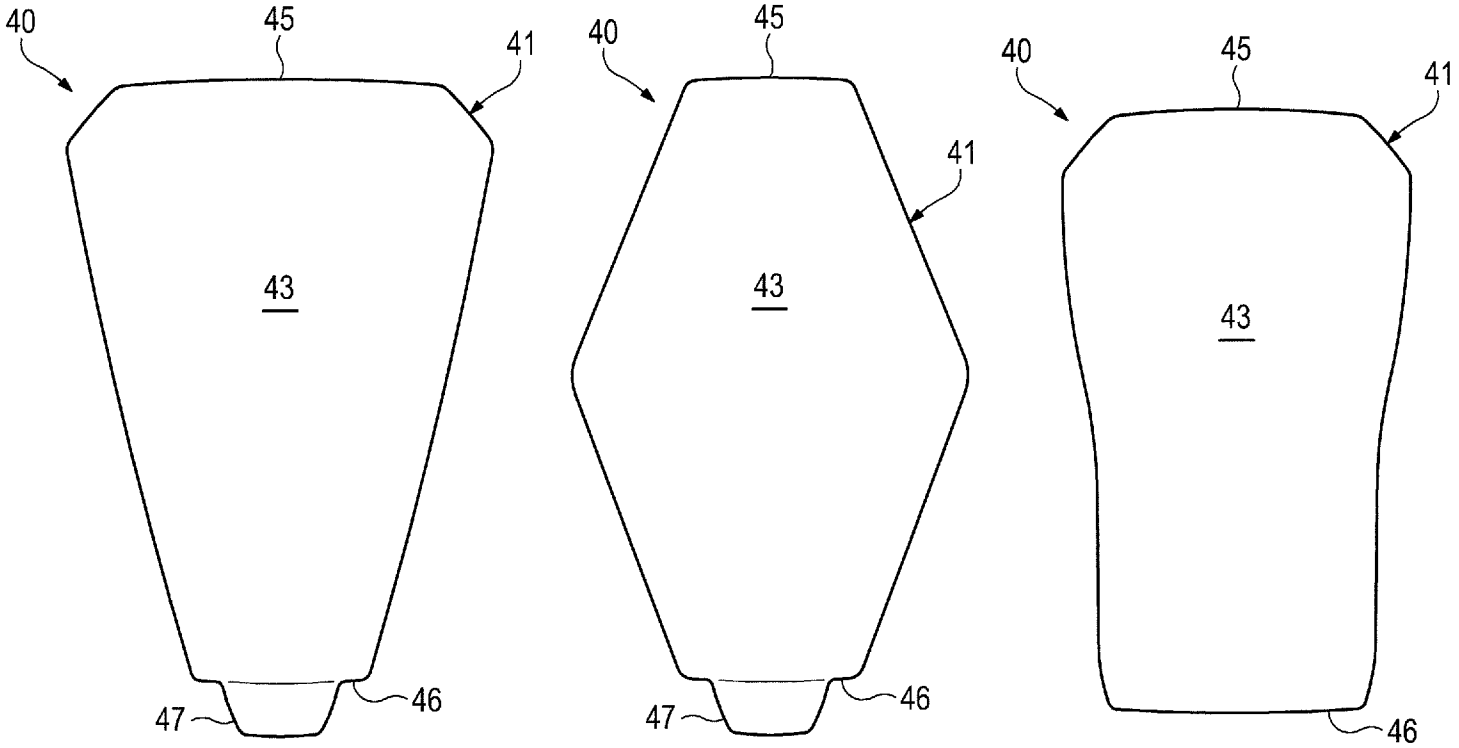

The configuration of tongue element 40 discussed above provides an example of a suitable configuration for footwear 10 and various other types of footwear. Tongue element 40 may, however, incorporate a variety of other features. Whether sheath 41 is formed through circular knitting or flat knitting, the overall shape of tongue element 40 may vary significantly. For example, FIG. 10A depicts a configuration wherein tongue element 40 has greater length and lesser width than the configuration from FIGS. 6-8, whereas FIG. 10B depicts a configuration wherein tongue element 40 has lesser length and greater width. Referring to FIG. 10C, tongue element 40 has indented side areas. Another configuration is depicted in FIG. 10D, wherein tongue element 40 tapers to impart a generally triangular shape. Additionally, tongue element 40 may exhibit a generally diamond-shaped configuration, as depicted in FIG. 10E. Referring to FIG. 10F, flanges 47 may also be absent from sheath 41.

A variety of methods may be utilized to impart the various shapes depicted in FIGS. 6-8 and 10A-10E. For example, the circular knitting or flat knitting processes that are utilized to form sheath 41 may impart any of the various shapes. That is, knitting machines may be programmed to mechanically-manipulate the yarn to form stitches that combine to impart any of the various shapes discussed above, as well as a variety of other shapes. As another example, stretcher forms may be placed within the cavity in sheath 41 and, upon the application of heat or steam, the stretcher form may modify the overall shape of sheath 41. Additionally, the shape of core 42 may vary to impart different shapes to sheath 41. An advantage to utilizing stretcher forms or different shapes of core 42 is that a plurality of sheaths 41 may be formed with substantially identical shapes, and the stretcher forms or differently-shaped cores 42 may be utilized to impart shapes to tongue 40 that are suitable for footwear having various sizes or for different types of footwear.

Figure 6:
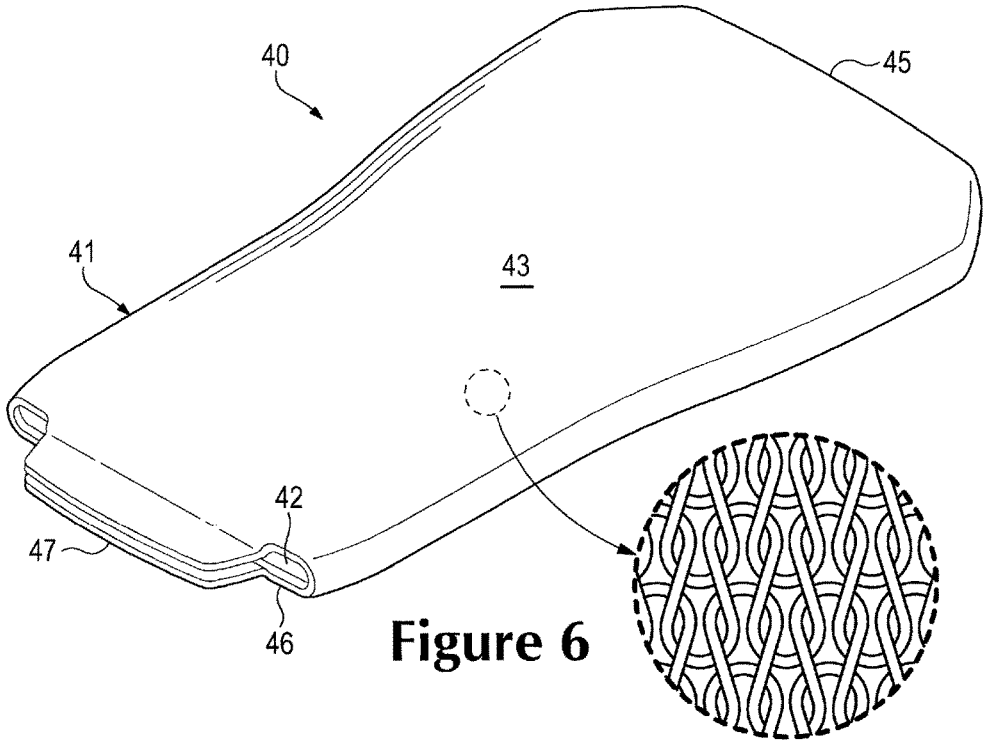
FIG. 6 is a perspective view of a tongue element of the article of footwear.
Figure 7:
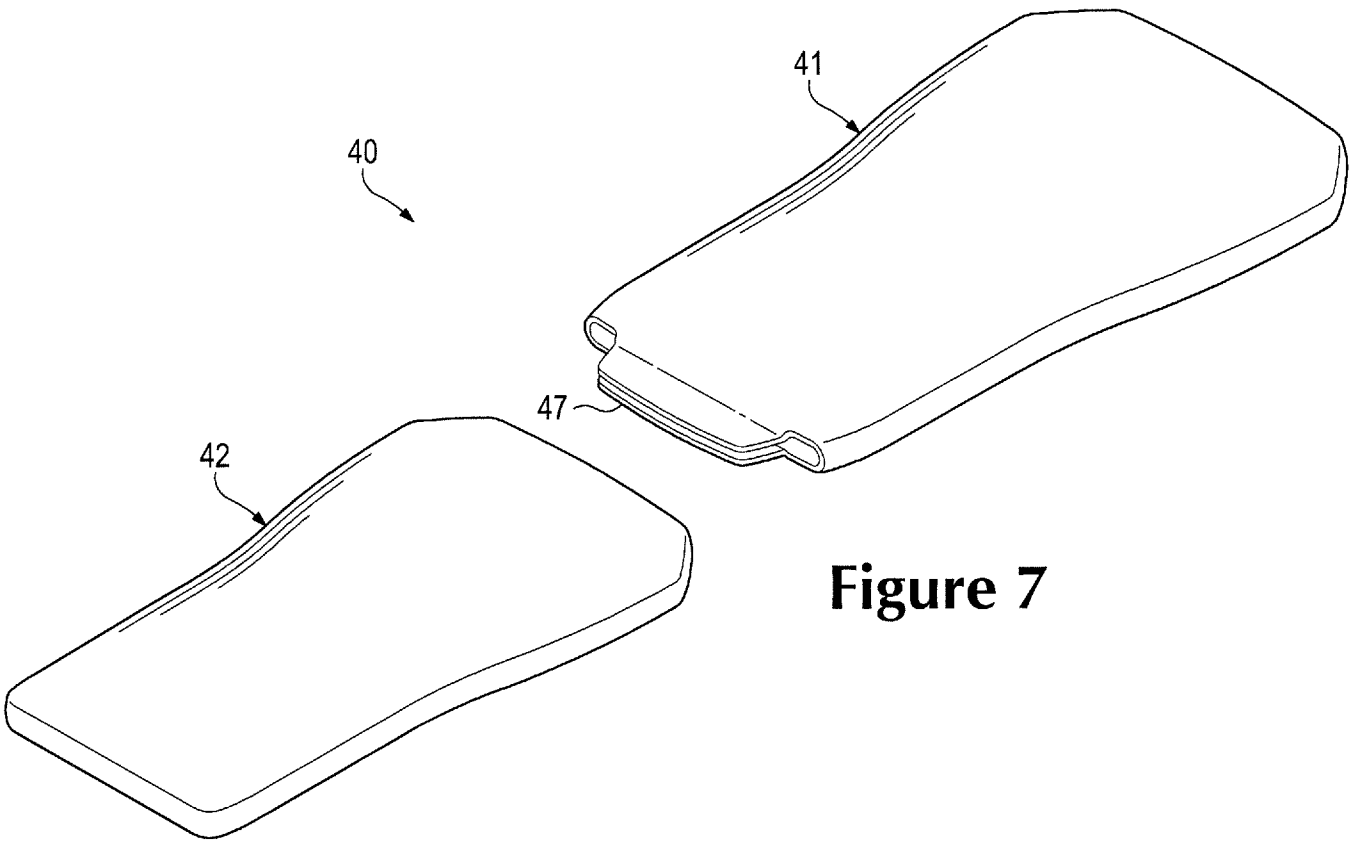
FIG. 7 is an exploded perspective view of the tongue element.
Figure 8:
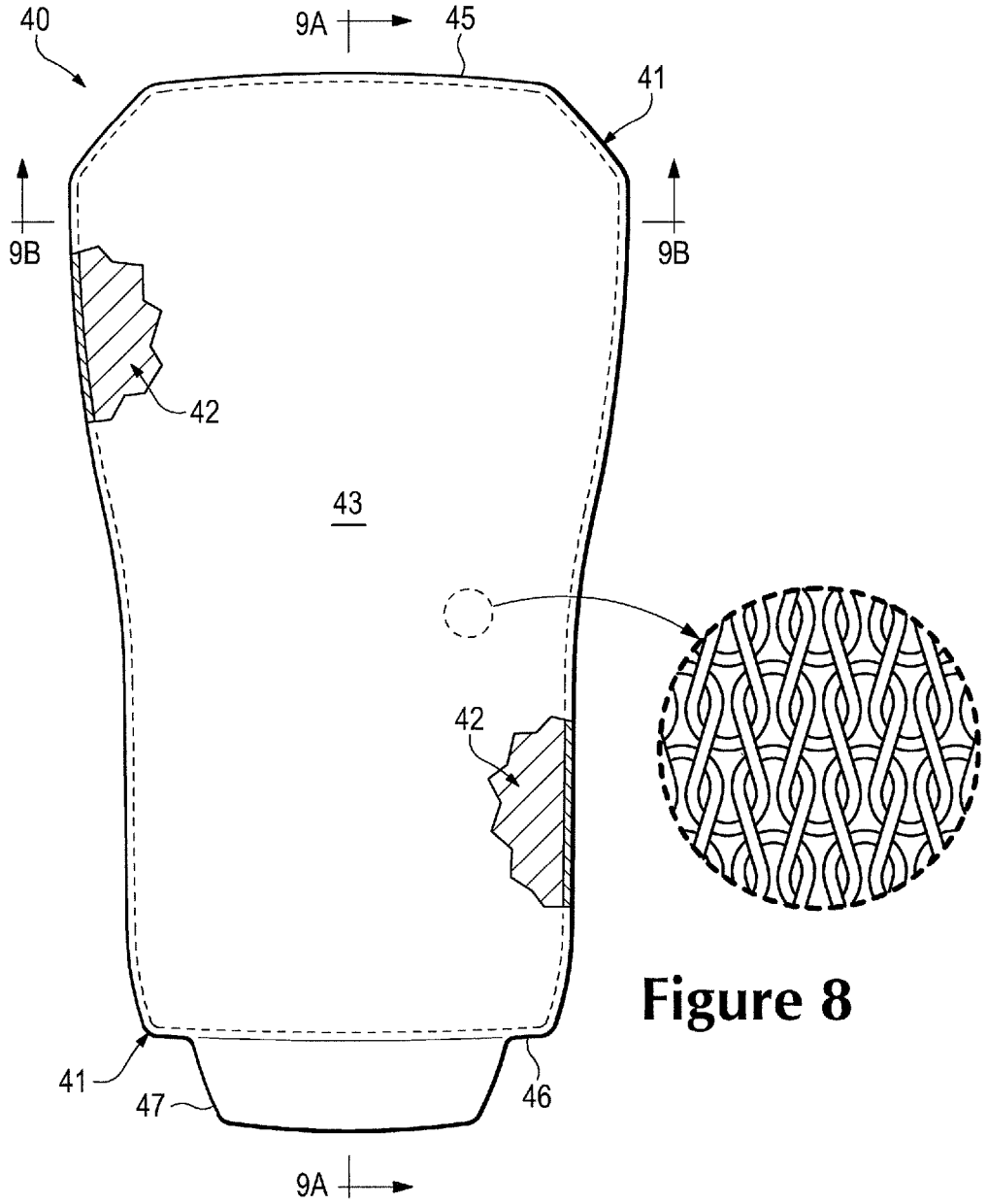
FIG. 8 is a plan view of the tongue element.

The configuration of sheath 41 depicted in FIGS. 6-8 incorporates a single type of yarn and a single stitch type. That is, sheath 41 has a generally continuous configuration wherein the properties imparted by the yarn and stitch type are generally the same throughout the various areas of sheath 41. By varying either or both of the yarn and stitch type utilized in various regions of sheath 41, the properties of the various regions may be modified. The yarn and stitch type may be varied, therefore, to impart different properties to different areas of tongue 40. Moreover, both circular knitting and flat knitting permit the combination of yarn and stitch type to be selected for the various regions of sheath 41, thereby allowing the properties of the regions to be selected based upon comfort or performance characteristics.

Figure 10G:
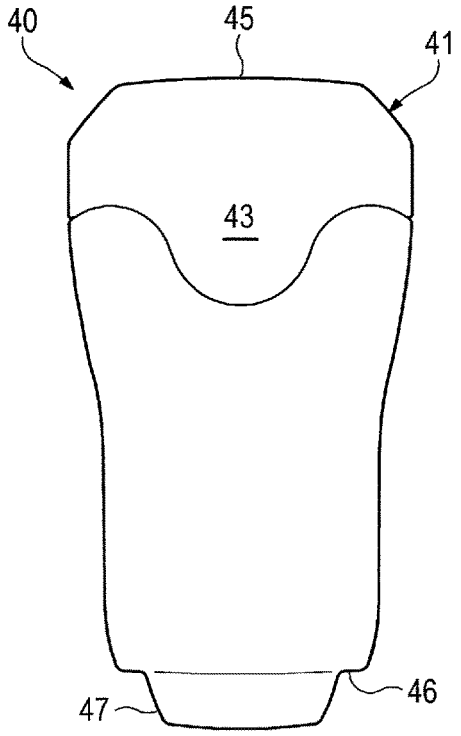
Figure 10H:
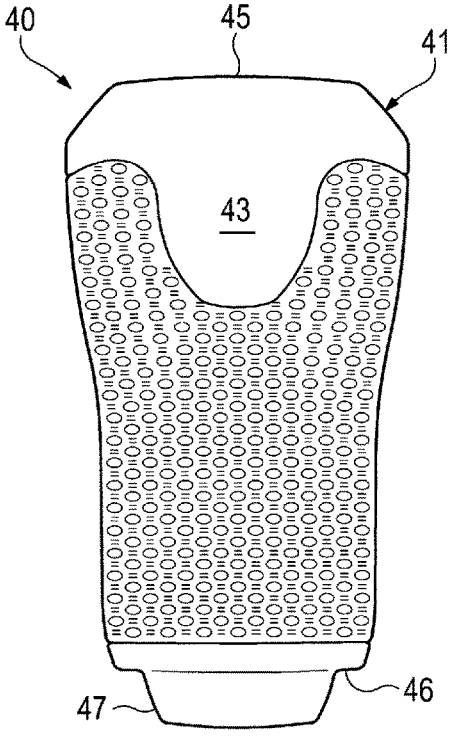

As discussed above, sheath 41 may incorporate various yarn and stitch types. As an example, sheath 41 is depicted as having two regions formed from different types of yarn in FIG. 10G. Whereas a region adjacent to first end 45 is formed from one type of yarn, a region adjacent to second end 46 is formed from another type of yarn. Whereas one region may incorporate elastane to enhance stretch, the other region may incorporate nylon to enhance wear-resistance and durability. Similarly, whereas one region may incorporate yarn with one denier, the other region may incorporate yarn with a greater denier to enhance the thickness or bulk. As another example, the stitch type may vary between the regions, as depicted in FIG. 10H. Whereas the region adjacent to first end 45 includes a stitch that imparts a relatively non-textured configuration, the region adjacent to second end 46 has a textured configuration that may impart stretch or different aesthetic qualities. The types of yarn utilized in the different regions of FIG. 10H may also vary to further enhance or vary the properties of tongue 40. As a related matter, the density of the knit within sheath 41 may vary among the regions to, for example, make less-permeable or stiffer portions. Accordingly, sheath 41 may exhibit various properties in separate regions depending upon the particular yarn and knit type that is selected for the regions.

Figure 10I:
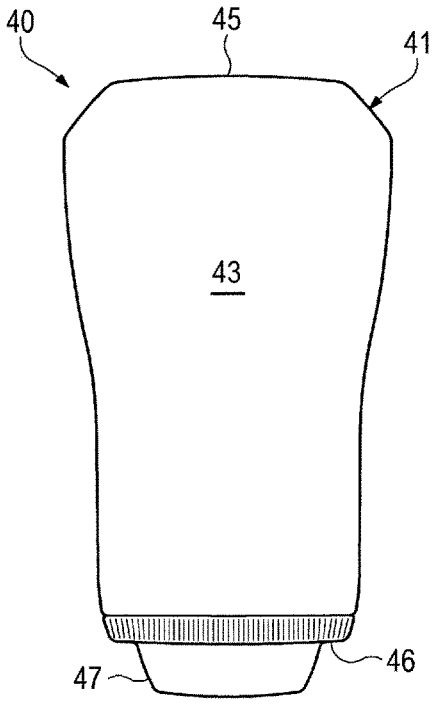
Figure 10J:
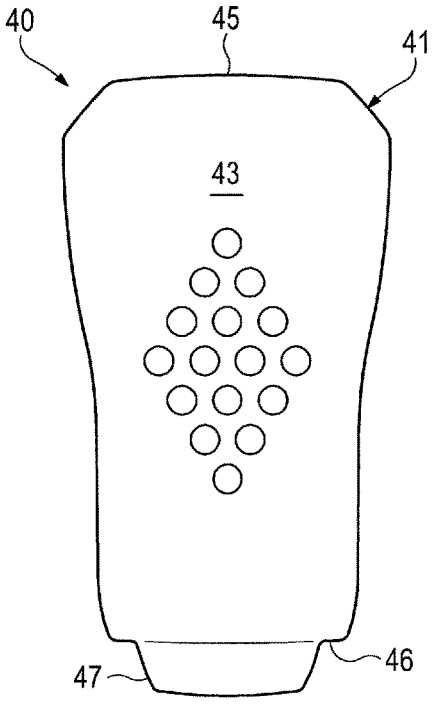

The yarn and knit type may also vary to enhance aspects related to assembling footwear 10. Referring to FIG. 10I, sheath 41 exhibits a ribbed configuration around the opening at second end 46. The ribbed configuration may stretch to permit the insertion of core 42, and then the ribbed configuration may contract to ensure that core 42 remains properly positioned within sheath 41. The knit type may also form various apertures in sheath 41, as depicted in FIG. 10J. In addition to imparting greater permeability, which allows air to circulate within upper 30, the apertures may increase both the flexibility and stretch of tongue 40. As further examples, other properties that may be varied through selecting particular yarn and knit types for sheath 41 include permeability to liquids, the directions in which sheath 41 stretches or resists stretching, and the stiffness of sheath 41.

Figure 11A:
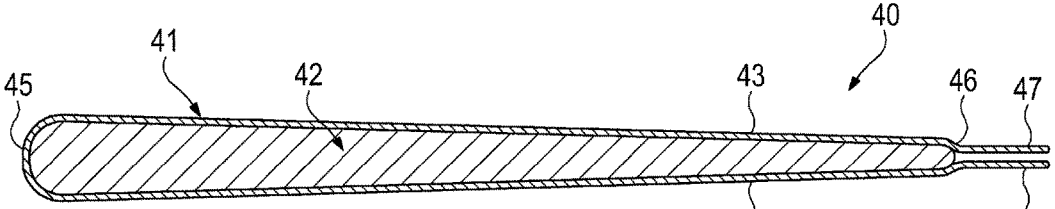
FIG. 11A-11K are cross-sectional views corresponding with FIG. 9A and depicting further configurations of the tongue element.
Figure 11B:
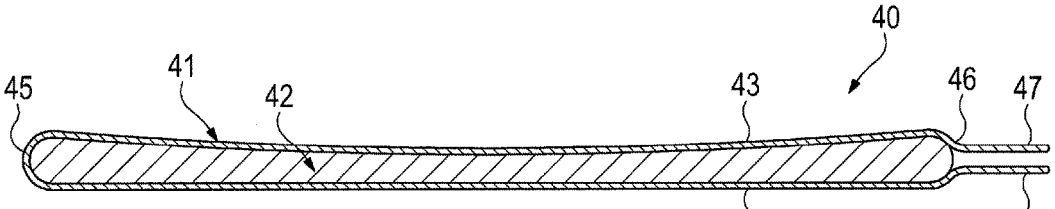
Figure 11C:
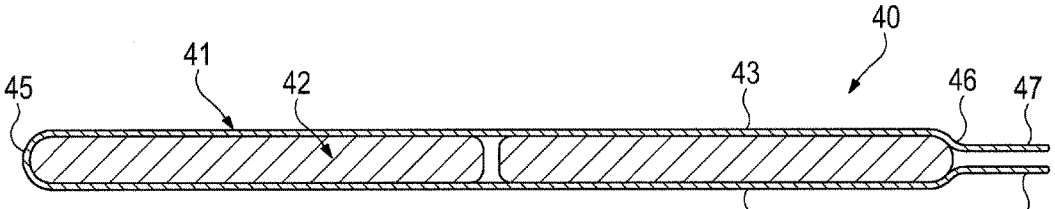
Figure 11D:
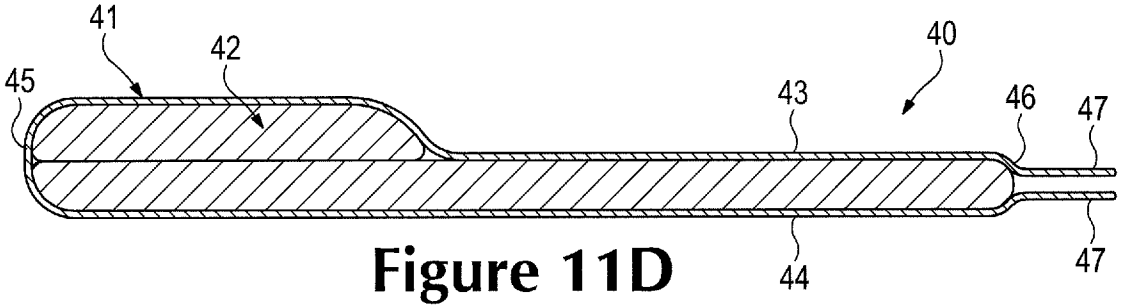
Figure 11E:
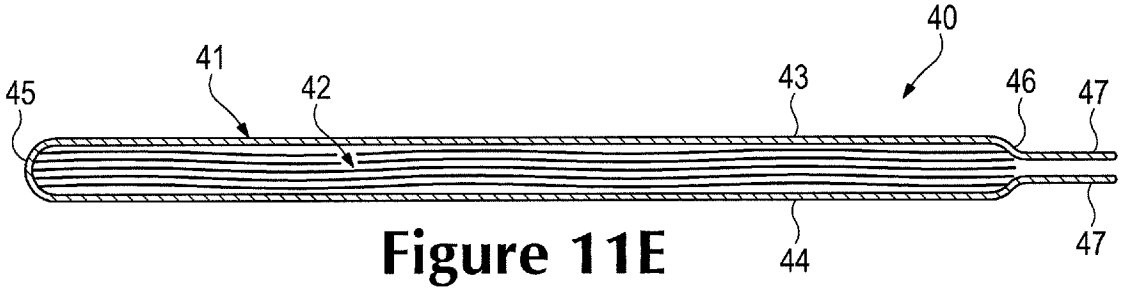
Figure 11F:
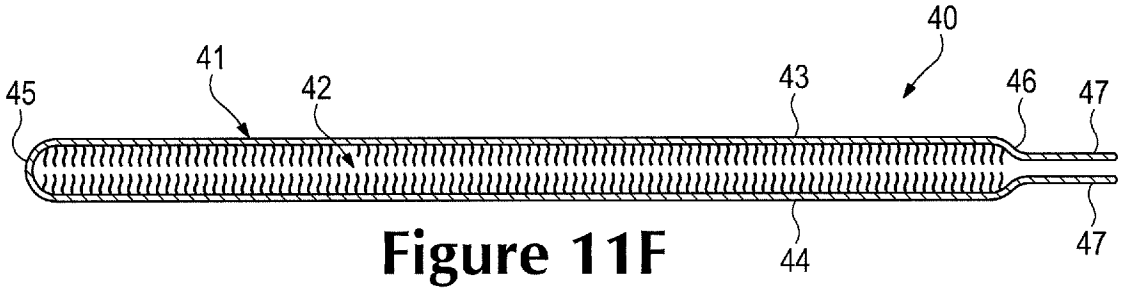

The overall configuration of core 42 may also vary depending upon various factors, including the size and type of footwear that tongue 40 is being incorporated into. For example, the thickness, length, and width of core 42 may be modified. Referring to FIG. 11A, core 42 exhibits a tapered configuration. Core 42 may also be contoured, as depicted in FIG. 11B. In some configurations of tongue 40, core 42 may be formed from two separate elements (e.g., foam elements with different densities), as depicted in FIG. 11C. In a similar configuration, core 42 may be formed from two overlapping elements (e.g., foam elements with different densities), as depicted in FIG. 11D, which imparts greater thickness and contours. Although foam elements may be utilized as core 42, various other materials may also be utilized. Referring to FIG. 11E, various floating yarns are located within the cavity formed by sheath 41. As described in greater detail below for collar element 50, flat knitting processes may locate floating yarns within a cavity formed between knit layers. Referring to FIG. 11F, cut ends from yarns in a circular knitting process, for example, provide material for core 42. Similarly, loops of yarn similar to loops in a terry cloth material may provide material for core 42. In some configurations, core 42 may also be formed from a fibrous mat made from recycled textile and yarn materials utilized in other areas of upper 30, or core 42 may be a fluid-filled bladder.

Figure 11G:
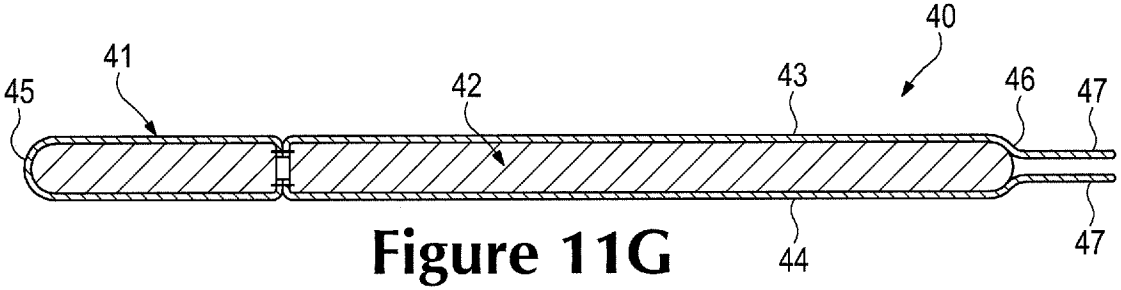
Figure 11H:
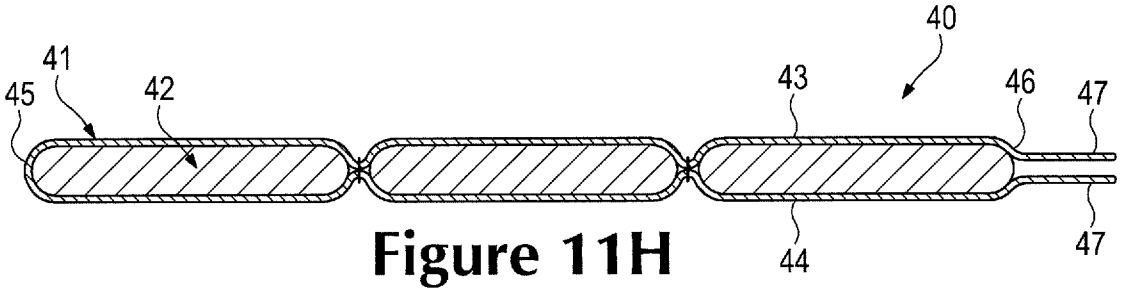
Figure 11I:
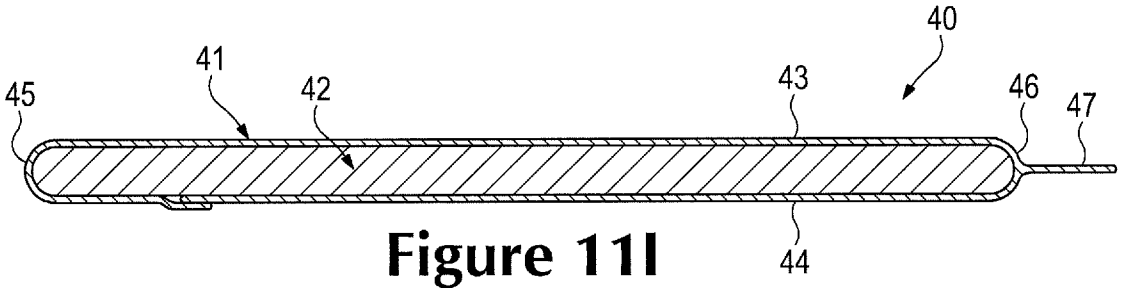
Figure 11J:
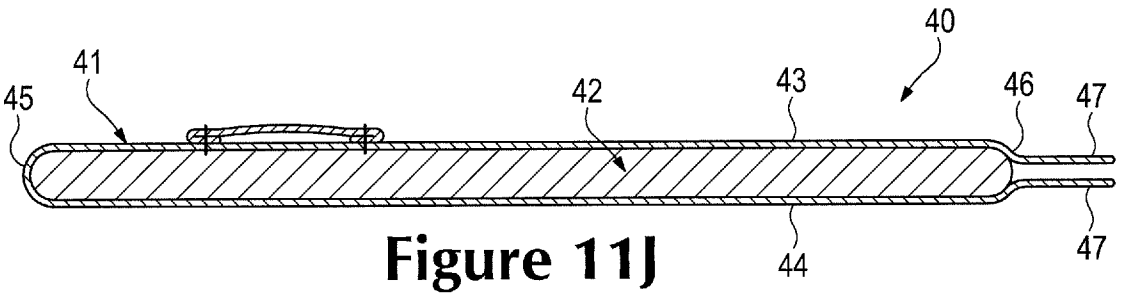
Figure 11K:
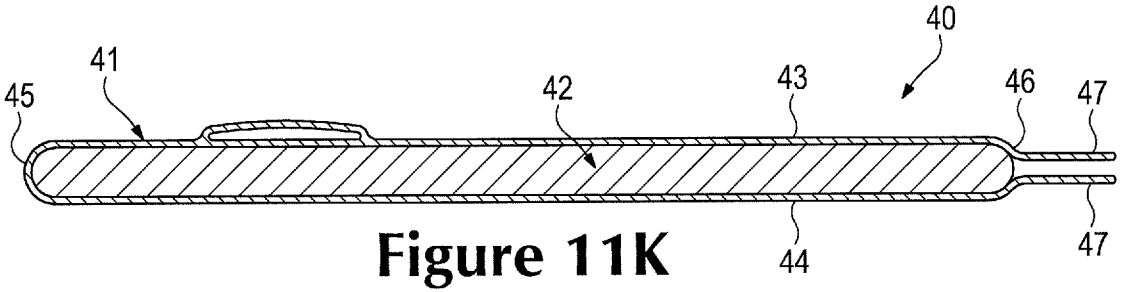

Although sheath 41 may be formed of unitary knit construction, sheath 41 may also be formed from joined elements that are each formed through knitting processes. Referring to FIG. 11G, sheath 41 includes a first knit element adjacent to first end 45 and a second knit element extending from the first knit element to second end 46, and the knit elements are joined through stitching. In some configurations, stitching may extend entirely through tongue 40, as depicted in FIG. 11H, to impart contours or other features to tongue 40. Although second end 46 may have an open configuration for inserting core 42, a flap may be formed in lower region 44, as depicted in FIG. 11I, for inserting core 42. As noted above, other elements that include a lace loop may be added to sheath 41, as depicted in FIG. 11J. As an alternative, a lace loop may be formed of unitary knit construction with sheath 41 during the flat knitting process, as depicted in FIG. 11K.

Based upon the above discussion, a variety of features of sheath 41 and core 42 may vary to impart different properties to tongue 40. As discussed, the overall shape of sheath 41 may vary depending upon the type of footwear or size of footwear tongue 40 is incorporated into. In some configurations, the yarn and/or stitch type may also vary among different regions of sheath 41 to impart different properties. Core 42 may also have a variety of shapes or be formed from various types of elements.

Knitting Processes

A variety of knitting processes, including circular knitting and flat knitting, may be utilized to manufacture sheath 41. Circular knitting is a form of knitting that creates a seamless tube, which is effectively the form of sheath 41. Various knitting machines may be utilized to form sheath 41 to have a circular knit structure. For example, specialized sock-knitting machines use individual latch-hook needles to make each stitch in a round frame. Depending upon the type of circular knitting machine utilized, first end 45 may be closed as part of the knitting cycle, or additional finishing steps may be performed to close first end 45. Flat knitting is a method for producing a knitted material that is turned periodically (i.e., the material is knitted from alternating sides). The two sides (otherwise referred to as faces) of the material are conventionally designated as the right side (i.e., the side that faces outwards, towards the viewer) and the wrong side (i.e., the side that faces inwards, away from the viewer).

Advantageously, both circular knitting and flat knitting may be utilized to form sheath 41 to have, for example, (a) various yarn types that impart different properties to separate areas of sheath 41 and (b) various knit types that impart different properties to separate areas of sheath 41. Although each of circular knitting and flat knitting may be utilized to manufacture many configurations of sheath 41, flat knitting may be utilized to add further features to tongue 40, including (a) locating floating yarns within sheath 41 to form core 42, as in FIG. 11D, and (b) overlapping knitted layers that form a lace loop of unitary knit construction, as in FIG. 11I.

Whereas edges of many textile elements incorporated into footwear tongues are cut to expose ends of the yarns forming the textile elements, sheath 41 may be formed to have a finished configuration when manufactured through circular knitting or flat knitting. That is, circular knitting or flat knitting may be utilized to form sheath 41 such that ends of the yarns within sheath 41 are substantially absent from the edges of sheath 41. An advantage of the finished configuration is that the yarns forming the edges of sheath 41 are less likely to unravel and fewer finishing steps are necessary after manufacturing sheath 41. By forming finished edges, the integrity of sheath 41 is strengthened and fewer or no post-processing steps are required to prevent unraveling. In addition, loose yarns are also less likely to inhibit the aesthetic appearance of tongue 40. In other words, the finished configuration of sheath 41 may enhance the durability and aesthetic qualities of tongue 40, while increasing manufacturing efficiency.

Figure 12A:
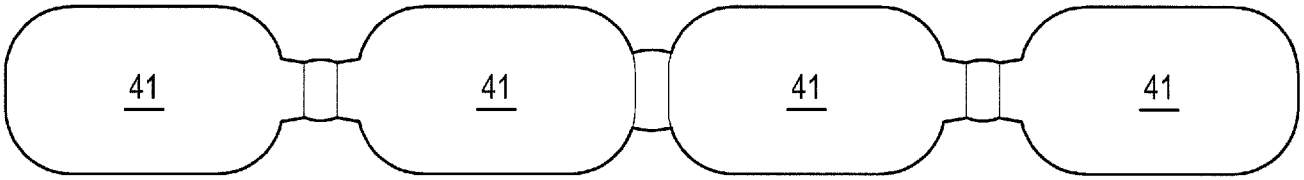
FIGS. 12A and 12B are plan views of various joined tongue elements.
Figure 12B:
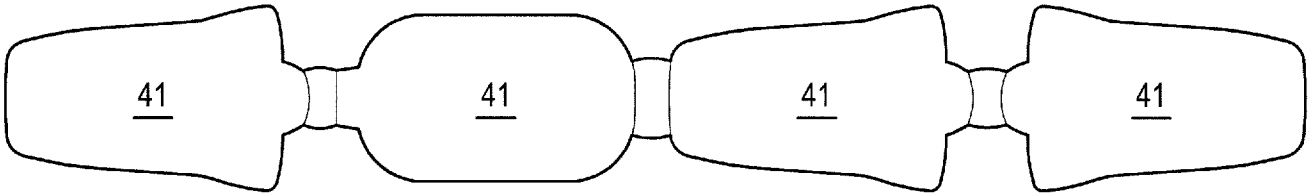

Circular knitting machines and flat knitting machines may be utilized to form an individual sheath 41. In order to enhance manufacturing efficiency, knitting machines may also be utilized to form a series of joined sheaths 41, as depicted in FIGS. 12A and 12B. That is, the knitting machines may form a single component that includes a plurality of sheaths 41. Referring to FIG. 12A, each of the sheaths 41 may have substantially identical shapes and sizes. Alternately, each of the sheaths 41 may have different shapes and sizes, as depicted in FIG. 12B. Moreover, a knit release area may be knitted into the series of sheaths 41 in order to allow the various sheaths 41 to be separated without the need for cutting operations.

Collar Element Configuration

Collar element 50 extends around heel region 13 and from lateral side 14 to medial side 15 to form an ankle opening for providing the foot with access to the void within upper 30. Collar element 50, which is depicted individually in FIGS. 13-15B, is formed by two overlapping and at least partially coextensive layers of knitted material, particularly an outer layer 51 and an opposite inner layer 52, that envelop a plurality of floating yarns 53. Although edges of layers 51 and 52 are secured to each other in a seamless manner (i.e., of unitary knit construction) through a knitting process, a central area between layers 51 and 52 is generally unsecured to each other in order to form a cavity in which floating yarns 53 are located. As such, the layers of knitted material effectively form a tube or tubular structure, and floating yarns 53 may be located or laid-in between layers 51 and 52 and oriented to be generally parallel to surfaces of layers 51 and 52. That is, floating yarns 53 extend between layers 51 and 52 and also pass through and fill an interior cavity between layers 51 and 52. Whereas layers 51 and 52 are formed from yarns that are mechanically-manipulated (e.g., through a flat knitting process), floating yarns 53 are generally free or otherwise laid-in within the cavity between layers 51 and 52 during the knitting process.

Whereas outer layer 51 forms a portion of an exterior surface of upper 30 in the area of the ankle opening, inner layer 52 forms a portion of the interior surface of upper 30 (i.e., the surface defining the void within upper 30). In an upper area of collar element 50, layers 51 and 52 are seamlessly-joined to each other. Similarly, layers 51 and 52 are seamlessly-joined to each other in a lower area of collar element 50. Additionally, a flange 54 extends outward from layers 51 and 52 and is utilized to join collar element 50 to a remainder of upper 30. More particularly, flange 54 extends between layers 31 and 32 and are secured to either or both of layers 31 and 32, as depicted in FIGS. 5A and 5C.

The presence of floating yarns 53 imparts a compressible aspect to collar element 50, thereby enhancing the comfort of footwear 10 in the area of the ankle opening. Many conventional articles of footwear incorporate polymer foam elements or other compressible materials into a collar area. In contrast with the conventional articles of footwear, collar element 50 utilizes floating yarns 53 to provide a compressible structure. In some configurations, foam elements or other fibrous elements (e.g., floating yarns and cut ends of yarns) may be located within collar element 50 and in place of floating yarns 53.

Any of the various types of yarn discussed above for sheath 41 may also be utilized in collar element 50. In some configurations, the yarns utilized in layers 51 and 52 may be the same as the yarns utilized for floating yarns 53, or different types of yarn may be utilized for floating yarns 53. As with sheath element 41, collar element 50 may be formed with different yarns in various regions or different stitch types in the various regions.

Collar element 50 may be formed through a flat knitting process to have a unitary knit construction. As such, collar element 50 is constructed as a one-piece knit element that is substantially free of additional stitching or bonding processes. That is, the knitting process substantially forms the various features and structures of collar element 50 without the need for significant additional processes. As discussed above, flat knitting may be utilized to form collar element 50 to have, for example, (a) various yarn types that impart different properties to separate areas of collar element 50 and (b) various knit types that impart different properties to separate areas of collar element 50. Flat knitting may also be utilized to add further features to collar element 50, including (a) forming the tubular structure of layers 51 and 52, (b) forming flange 54 to extend seamlessly-outward from the tubular structure of layers 51 and 52, and (c) locating floating yarns 53 between layers 51 and 52.

Collar element 50 may be formed to have a finished configuration when manufactured through flat knitting. That is, flat knitting may be utilized to form collar element 50 such that ends of the yarns are substantially absent from the edges of collar element 50. As with sheath 41, an advantage of the finished configuration is that the yarns are less likely to unravel and fewer finishing steps are necessary after manufacturing. By forming finished edges, the integrity of collar element 50 is strengthened and fewer or no post-processing steps are required to prevent unraveling. In addition, loose yarns are also less likely to inhibit the aesthetic appearance of collar element 50.

Figure 13:
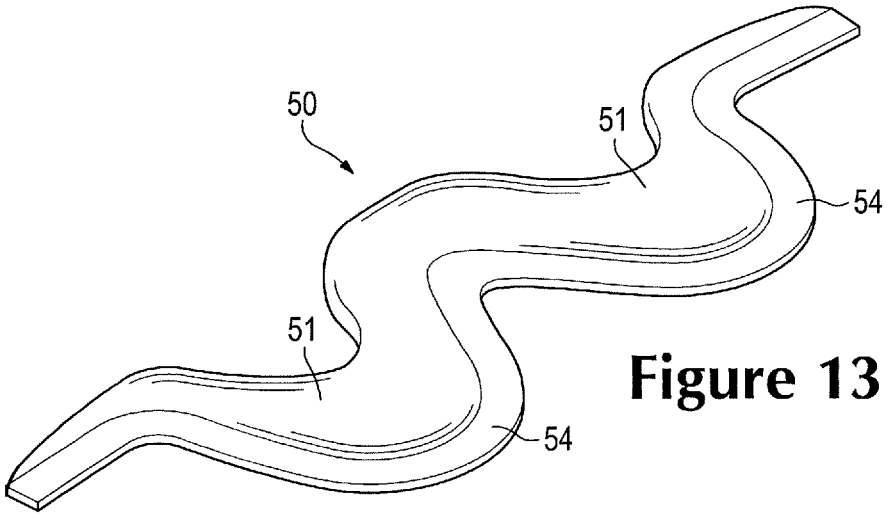
FIG. 13 is a perspective view of a collar element of the article of footwear.
Figure 14:
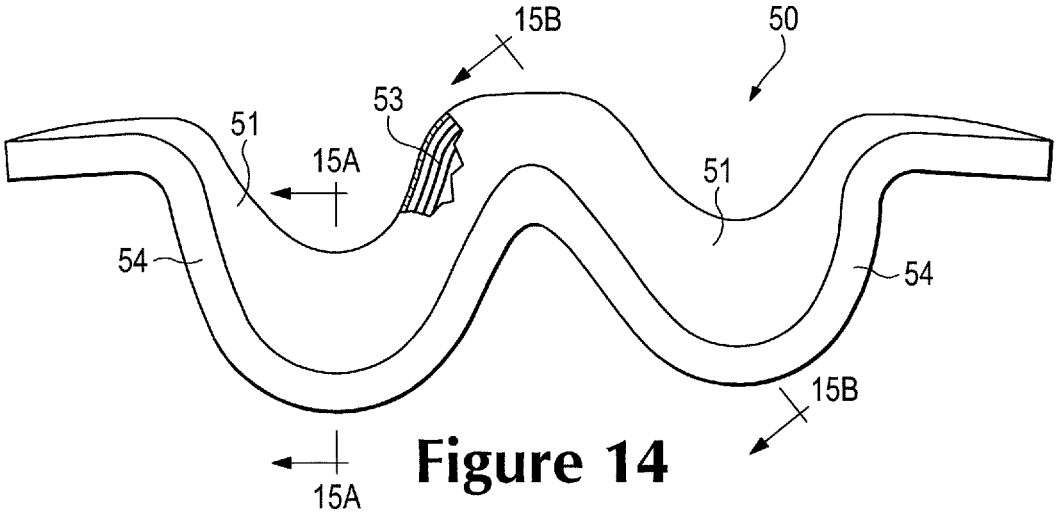
FIG. 14 is a plan view of the collar element.
Figure 15A:
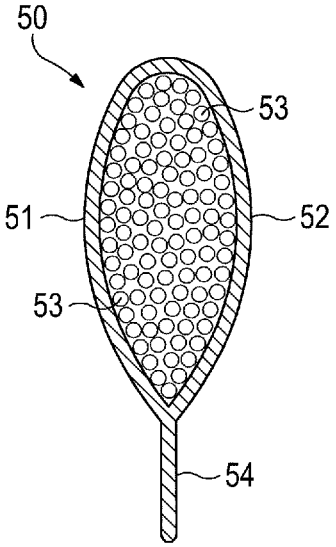
FIGS. 15A and 15B are cross-sectional views of the collar element, as respectively defined by section lines 15A and 15B in FIG. 14.
Figure 15B:
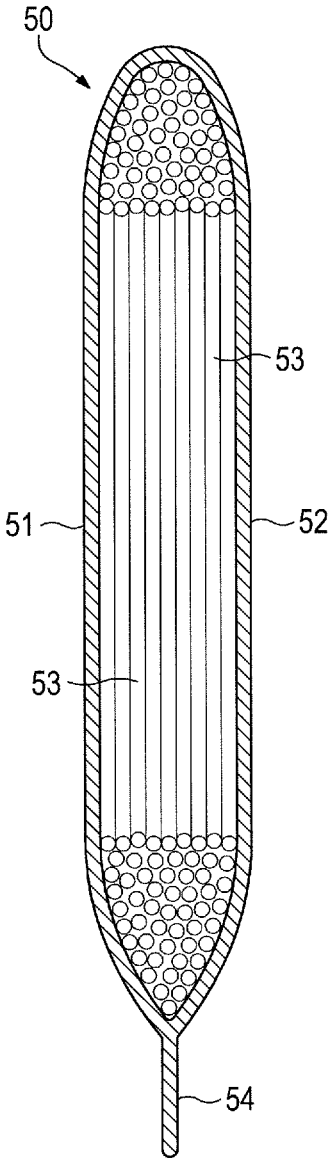
Figure 16A:
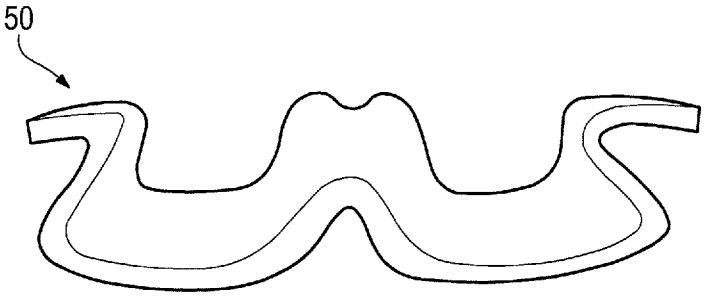
FIGS. 16A-16C are plan views corresponding with FIG. 14 and depicting further configurations of the collar element.
Figure 16B:
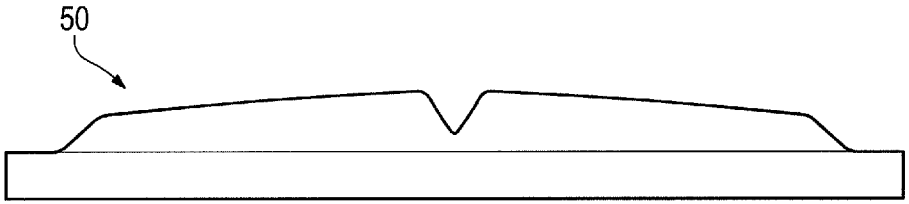
Figure 16C:
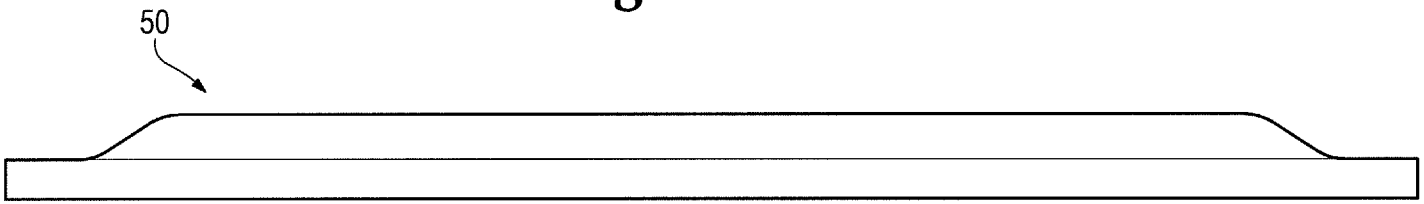

The specific shape of collar element 50 in FIGS. 13 and 14 is intended to provide an example of a shape that is suitable for footwear 10. A variety of other shapes may also be utilized. As an example, FIG. 16A depicts a more contoured configuration. As further examples, FIGS. 16B and 16C depict simpler collar profiles that may be incorporated into a variety of footwear types.

Figure 17A:
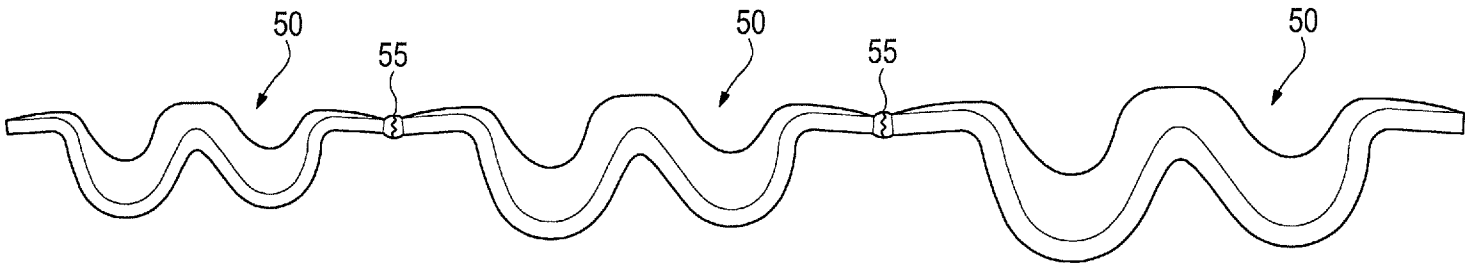
FIGS. 17A and 17B are plan views of various joined collar elements.
Figure 17B:
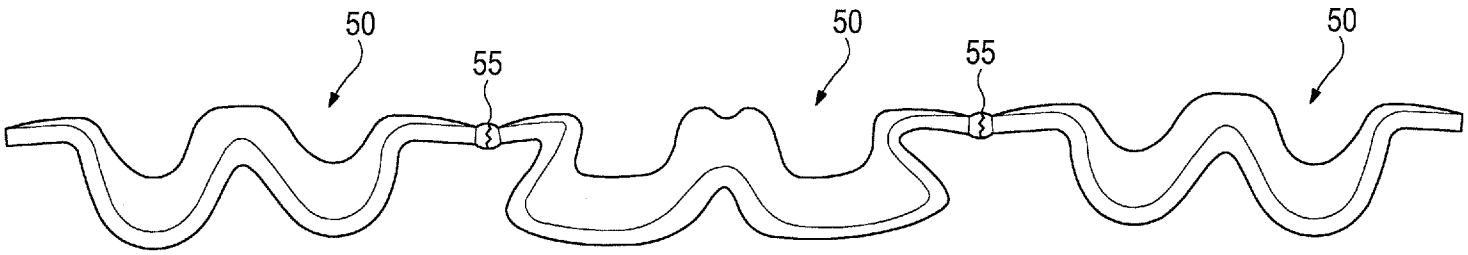

A flat knitting machine may be utilized to form an individual collar element 50. In order to enhance manufacturing efficiency, knitting machines may also be utilized to form a series of joined collar elements 50, as depicted in FIGS. 17A and 17B. That is, the knitting machines may form a single component that includes a plurality of collar elements 50. Referring to FIG. 17A, each of the collar elements 50 may have substantially identical shapes, but different sizes that are suitable for different sizes of footwear 10. Alternately, each of the collar elements 50 may have different shapes and sizes, as depicted in FIG. 17B. A knit release area may be knitted into the series of collar elements 50 in order to allow the various collar elements 50 to be separated without the need for cutting operations. More particularly, a release thread 55 that is located in the release area during the knitting process may extend between the various collar elements 50. By pulling or otherwise removing release thread 55, collar elements 50 may be separated without cutting or other manufacturing steps. A similar release thread may be utilized to separate the various sheaths depicted in FIGS. 12A and 12B.

Collar-Throat Element

Figure 18:
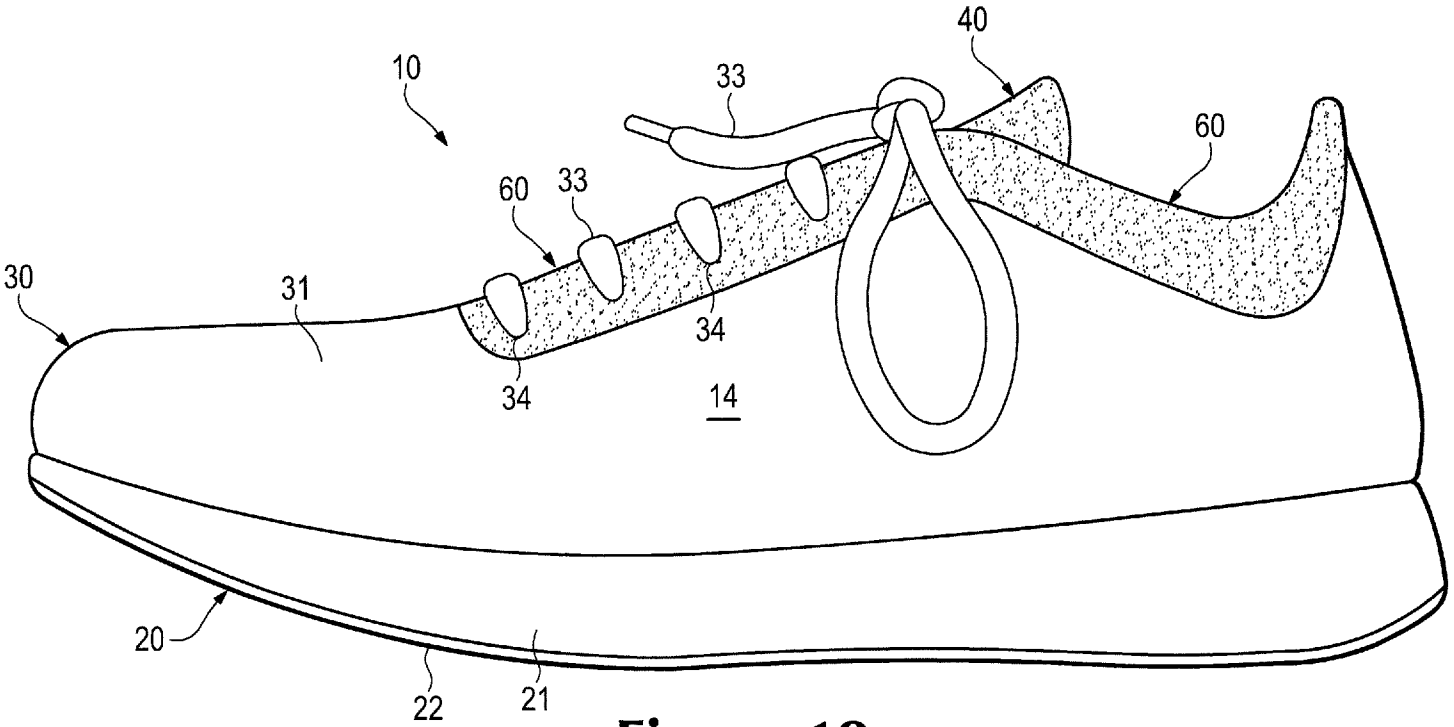
FIG. 18 is a lateral side elevational view corresponding with FIG. 2 and depicting another configuration of the article of footwear.

Another configuration of footwear 10 is depicted in FIG. 18 as including a collar-throat element 60 that extends at least partially around the ankle opening and also extends into the throat area of footwear 10 defining the various lace apertures 34 on lateral side 14. A similar collar-throat element may also be located on medial side 15. Collar-throat element 60 is similar in construction to collar element 50 and includes an outer layer 61, an opposite inner layer 62, a plurality of floating yarns 63, and a flange 64. Although edges of layers 61 and 62 are secured to each other, a central area between layers 61 and 62 is generally unsecured to each other in order to form a cavity in which floating yarns 63 are located. As such, the layers of knitted material effectively form a tube or tubular structure, and floating yarns 63 may be located or laid-in between layers 61 and 62.

Figure 21A:
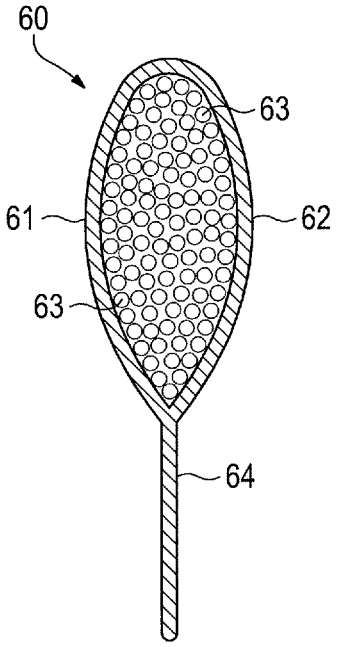
FIGS. 21A and 21B are cross-sectional views of the collar-throat element, as respectively defined by section lines 21A and 21B in FIG. 20.
Figure 21B:
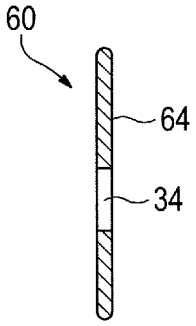

Whereas outer layer 61 forms a portion of an exterior surface of upper 30 in the area of the ankle opening, inner layer 62 forms a portion of the interior surface of upper 30 (i.e., the surface defining the void within upper 30). In an upper area of collar element 50, layers 61 and 62 are seamlessly-joined to each other. Similarly, layers 61 and 62 are seamlessly-joined to each other in a lower area of collar-throat element 60. Additionally, flange 64 extends outward from layers 61 and 62 and is utilized to join collar-throat element 60 to a remainder of upper 30. As with collar element 50, flange 64 may extend between layers 31 and 32 and are secured to either or both of layers 31 and 32. Flange 64 extends into the throat area and defines various lace apertures 34 as shown, for example, in FIG. 21B which is a cross-sectional view of the collar-throat element as defined by section line 21B in FIG. 2. A portion of flange 64 adjacent to lace apertures 34 may also extend between layers 31 and 32 and be secured to either or both of layers 31 and 32.

Figure 19:
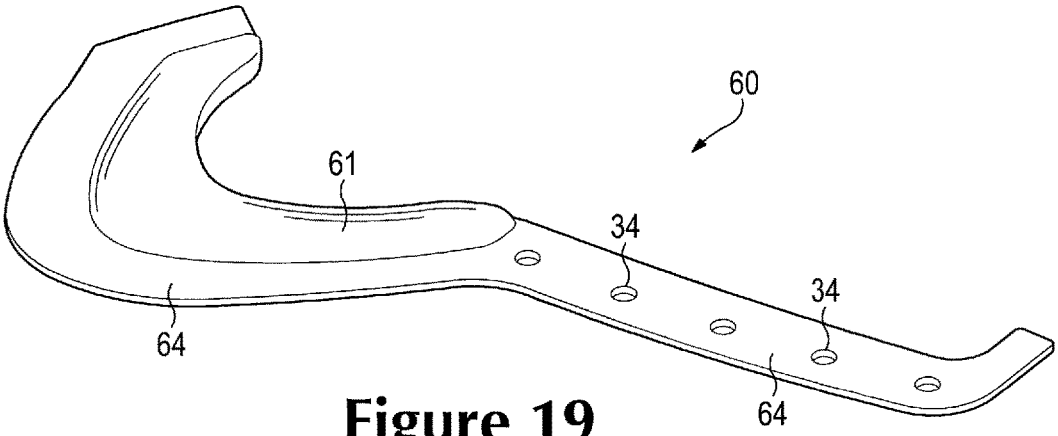
FIG. 19 is a perspective view of a collar-throat element of the configuration of the article of footwear depicted in FIG. 18.
Figure 20:
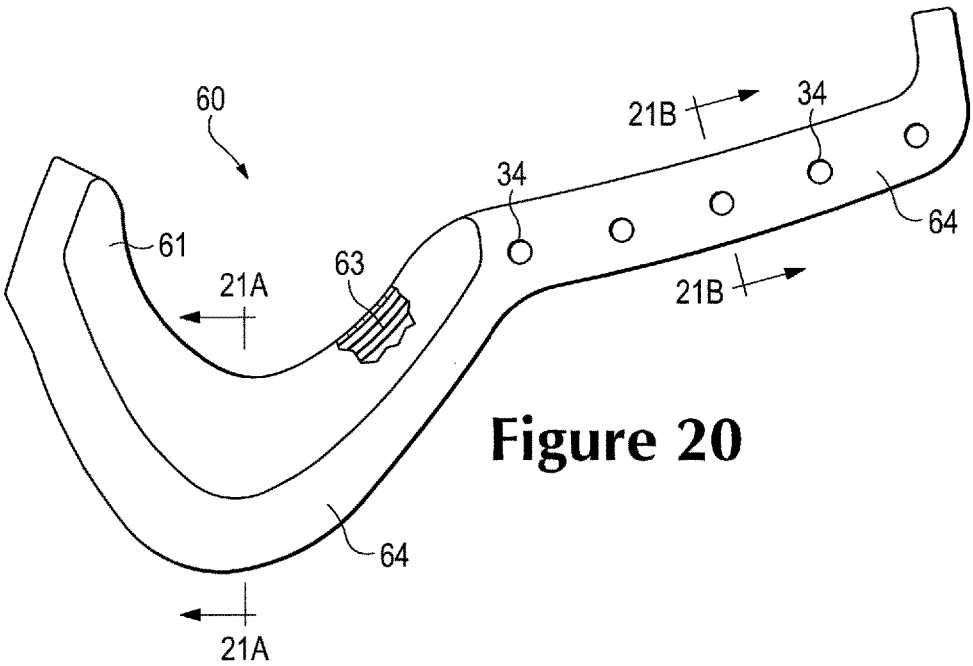
FIG. 20 is a plan view of the collar-throat element.

Collar-throat element 60 may be formed through a flat knitting process to have a unitary knit construction, and may also be formed to have a finished configuration. Additionally, any of the various types of yarn or stitch types discussed above may also be utilized in collar-throat element 60. The specific shape of collar-throat element 60 in FIGS. 19 and 20 is intended to provide an example of a shape that is suitable for footwear 10. In the configuration depicted in FIGS. 19 and 20, collar-throat element 60 is limited to lateral side 14, and another element may be utilized on medial side 15. In further configurations, however, a single collar-throat element 60 may extend around heel region 13 to form the ankle opening on both of sides 14 and 15, and the single collar-throat element 60 may extend through the throat area on both of sides 14 and 15 to form each of lace apertures 34. A variety of other shapes may also be utilized. As with sheath 41 and collar element 50, a knitting machine may form a single component that includes a plurality of joined collar-throat elements 60 in order to increase manufacturing efficiency.

Figure 23:
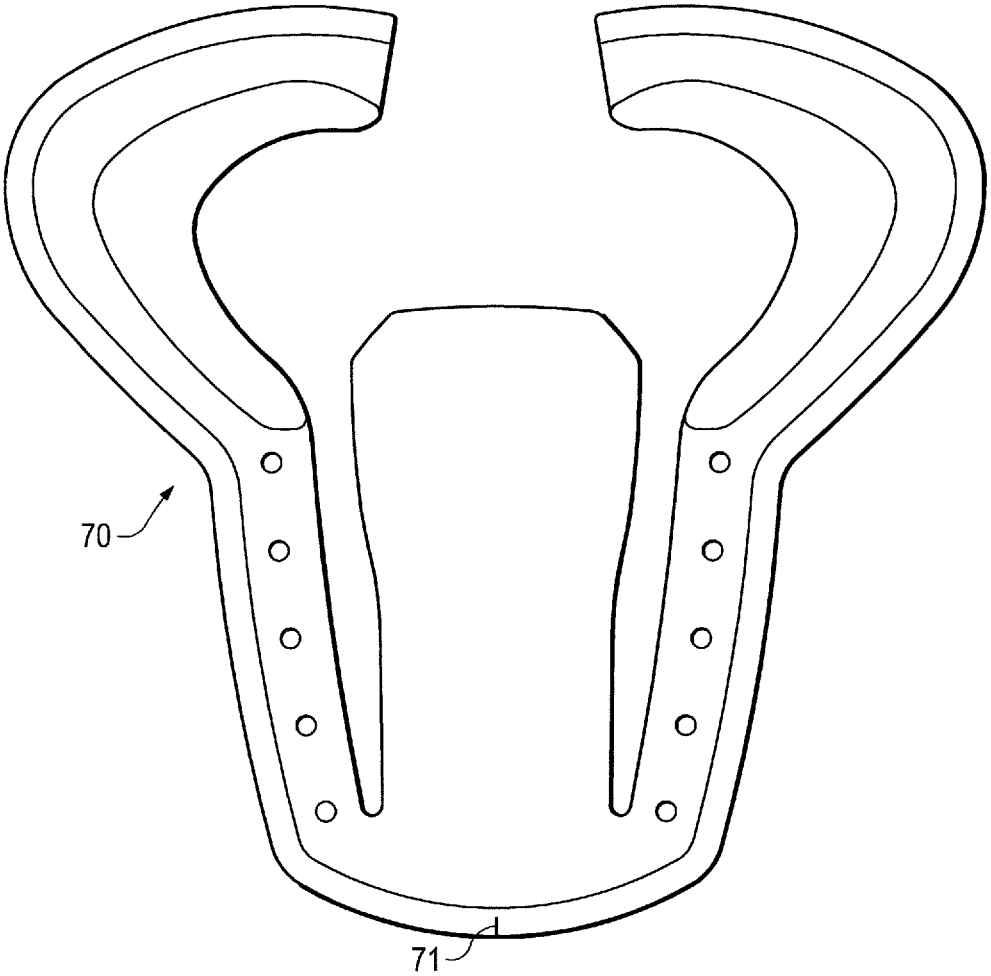
FIG. 23 is a plan view of another element.
Figure 24:
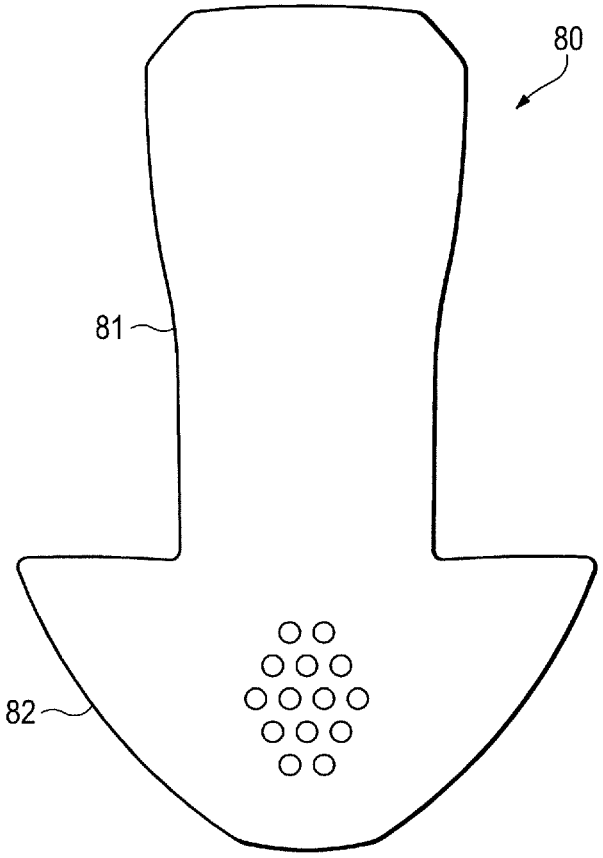
FIG. 24 is a plan view of a tongue-vamp element.
Figure 25:
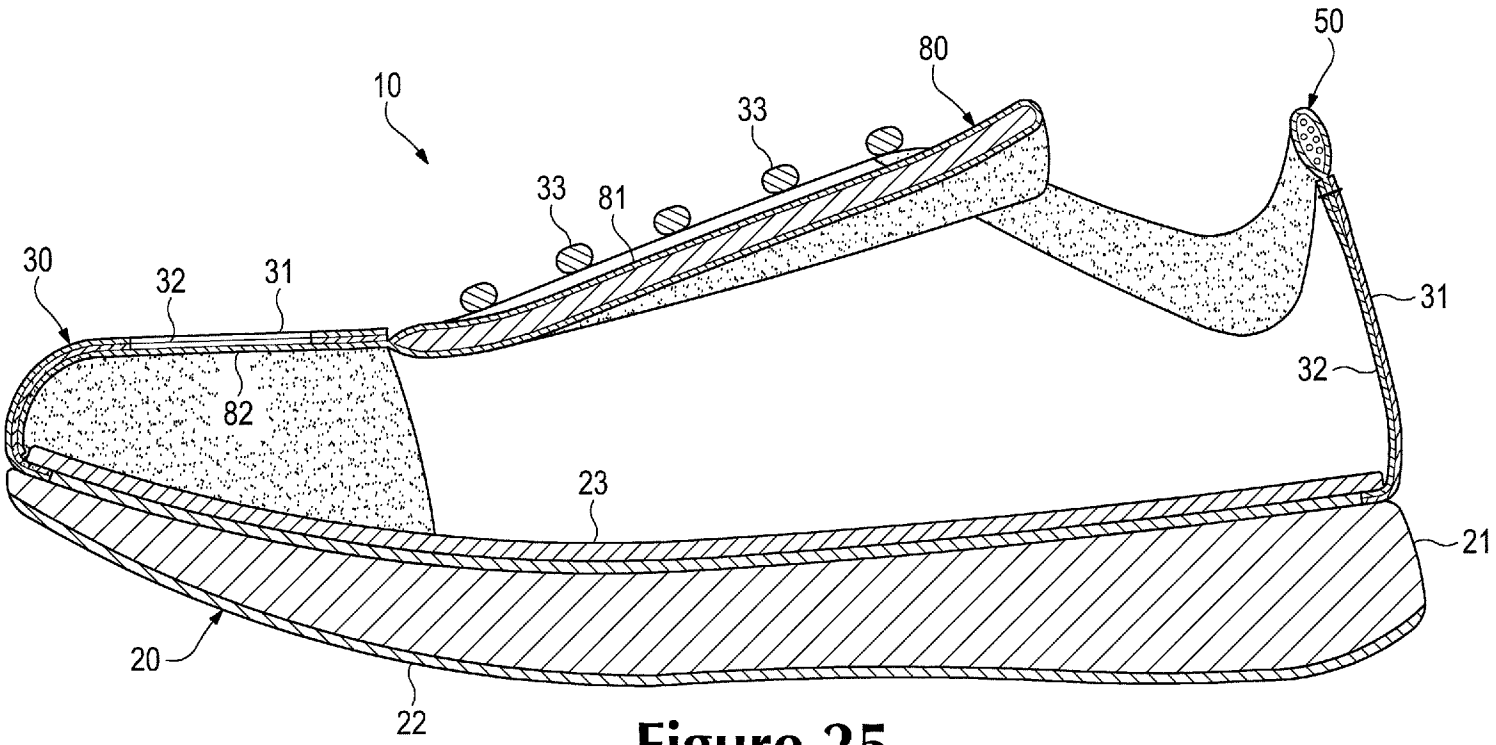
FIG. 25 is a cross-sectional view corresponding with FIG. 5A and depicting the tongue-vamp element in the article of footwear.

Another element 70 is depicted in FIG. 23 as being a combination of tongue element 40 and collar-throat element 60. Although flat knitting and circular knitting may be utilized to form discrete and relatively small areas of upper 30 (i.e., the areas formed by tongue element 40, collar element 50, and collar-throat element 60), knitting processes may also be utilized to form greater areas that have unitary knit construction. As another example, a tongue-vamp element 80 is depicted in FIG. 24. Tongue-vamp element 80 includes a tongue area 81 and a vamp area 82 that are formed of unitary knit construction. Whereas tongue area 81 may have the general configuration of tongue element 40, vamp area 82 may be a single layer of material, for example. When incorporated into footwear 10, as depicted in FIG. 25, vamp area 82 may form an interior lining. Moreover, a portion of vamp area 82 may be exposed through an aperture in layers 31 and 32. Although vamp area 82 may be formed to exhibit a single type of knit structure or may have various knit structures. For example, the area exposed through the aperture in layers 31 and 32 may define various apertures to enhance breathability.

Footwear Incorporation

Each of tongue element 40, collar element 50, and collar-throat element 60 include a compressible area and a flange area. In general, the compressible area forms a comfortable structure that may bear upon the foot, whereas the flange area is utilized to join the elements to footwear 10 (e.g., by joining between layers 31 and 32). With regard to tongue element 40, the compressible area includes portions of tongue element 40 where core 42 is located, and the flange area includes the two flanges 47. With regard to collar element 50, the compressible area includes layers 51 and 52 and floating yarns 53, and the flange area includes flange 54. Similarly, and with regard to collar-throat element 60, the compressible area includes layers 61 and 62 and floating yarns 63, and the flange area includes flange 64. This can be seen, for example, in FIG. 21A, which is a cross-sectional view of the collar-throat element defined by section lines 21A in FIG. 20. In each of these elements, the various flanges 47, 54, and 64 extend outward from the compressible area and are located inward from one of the material layers forming upper 30 (i.e., layer 31), and the various flanges 47, 54, and 64 are joined with the material layer or another portion of upper 30.

Figure 22A:
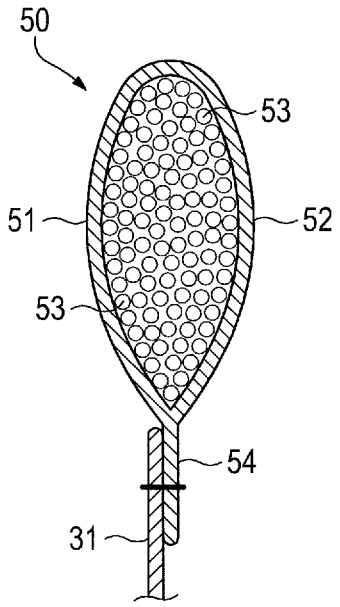
FIGS. 22A-22D are cross-sectional views corresponding with a portion of FIG. 5C and depicting various methods of incorporating the collar element into the article of footwear.
Figure 22B:
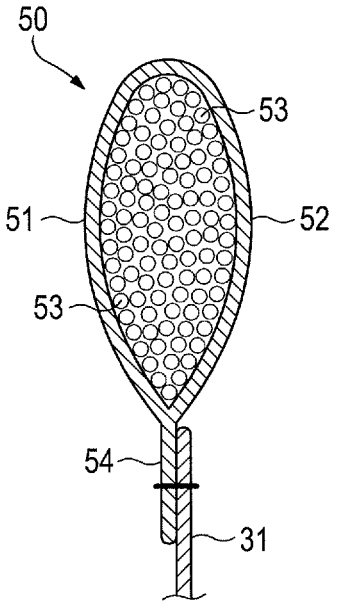
Figure 22C:
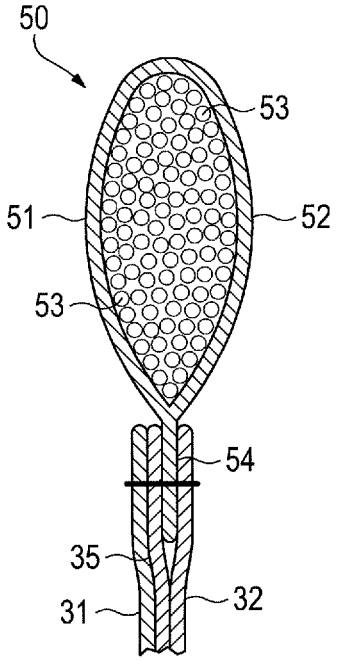
Figure 22D:
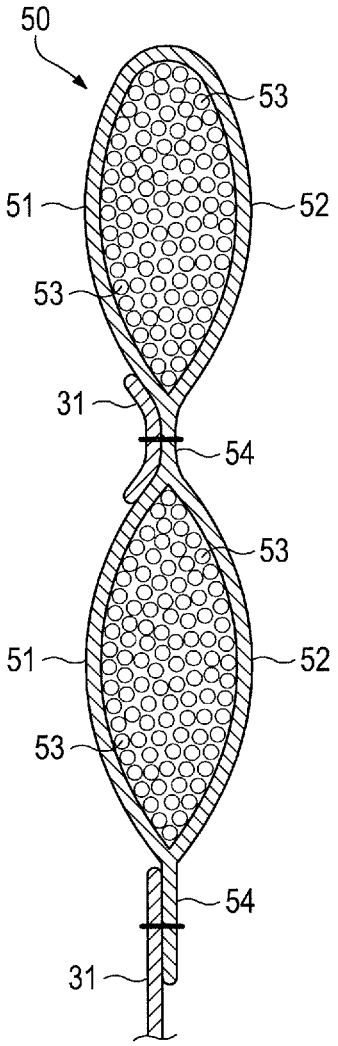
Figure 26:
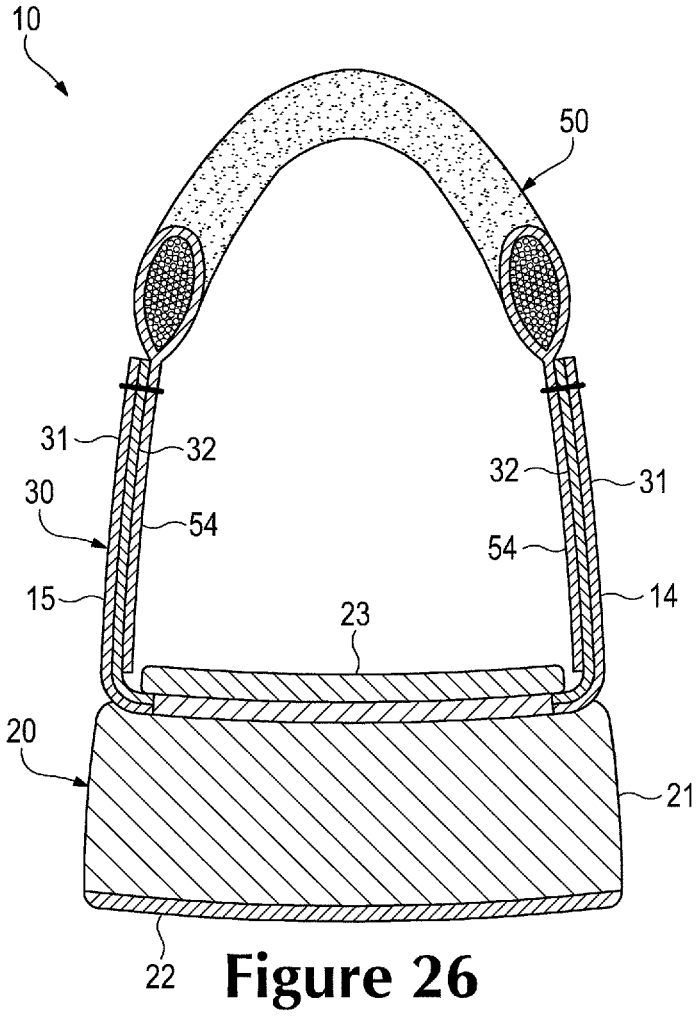
FIG. 26 is a cross-sectional view corresponding with FIG. 5C and depicting another configuration of the article of footwear.

Referring to FIGS. 5A and 5C, flanges 47 from tongue element 40 and flange 54 from collar element 50 are located between layers 31 and 32 and joined with at least one of layers 31 and 32. In other configurations, flanges 47 and 54 may be joined to an upper formed from a single layer or may be joined to an upper formed from multiple layers. For example, FIG. 22A depicts a configuration wherein collar element 50 is joined with an area of upper 30 including only layer 31. Although flange 54 may be joined to upper 30 inward from a material layer, such as layer 32, FIG. 22B depicts a configuration wherein collar element 50 is joined with an exterior of layer 31. FIG. 22C depicts a configuration wherein collar element 50 is joined to an area of upper 30 wherein a central layer 35 is present, and flange 54 is positioned between layers 32 and 35. In another configuration depicted in FIG. 22D, collar element 50 includes two compressible areas where floating yarns 53 are present, and one of the compressible areas is exposed through an aperture in layer 31. Similar concepts may be applied to the manner in which tongue element 40 and collar-throat element 60 are joined with other areas of upper 30. In another configuration depicted in FIG. 26, flanges 54 from collar elements 50 extend along the interior surface of the void within upper 30 to form a continuous lining. Accordingly, the manner in which flanges 47, 54, and 64 are utilized to join elements to an article of footwear may vary significantly.

When knitting collar-throat element 60, layers 61 and 62 and opposite sides of flange 64 may be knit symmetrically and of equal quality. When formed in this manner, collar-throat element 60 may be used on either lateral side 14 or medial side 15. That is, collar-throat element 60 may have a symmetrical aspect that allows it to be incorporated into either side of footwear 10, thereby reducing the types of elements that are manufactured for use in footwear 10.

Figure 27B:
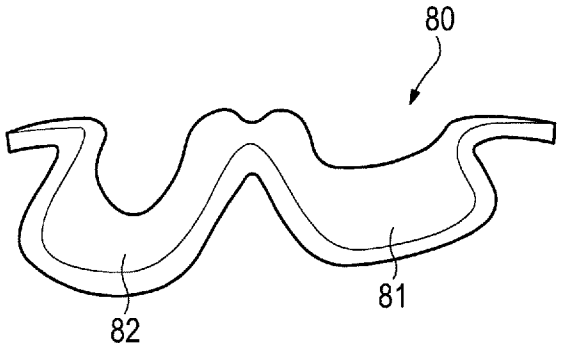
FIGS. 27A and 27B are plan views of another collar element.
Figure 27A:
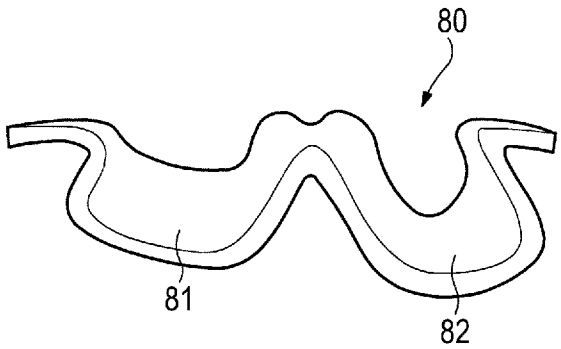

A further advantage of forming knitted elements to have opposite sides of equal quality is that an individual element may be incorporated into versions of footwear 10 for either the right foot or the left foot. Referring to FIGS. 27A and 27B, for example, opposite sides of another collar element 80 are depicted. Collar element 80 is similar to collar element 50 and has (a) a lateral portion 81 intended to extend into lateral side 14 of footwear 10 and (b) a medial portion 82 intended to extend into medial side 15 of footwear 10. Portions 81 and 82 are shaped differently and impart an asymmetrical aspect to collar element 80 that is suited for sides 14 and 15. The opposite sides or faces of collar element 80, however, are symmetrical and of equal quality. When incorporated into footwear 10, the side that faces outward depends upon whether footwear 10 is shaped for the right foot or the left foot. That is, one side (i.e., the side depicted in FIG. 27B) will face outward when incorporated into footwear 10 for the right foot, and an opposite side (i.e., the side depicted in FIG. 27A) will face outward when incorporated into footwear 10 for the left foot. Identical collar elements 80 may, therefore, be incorporated into footwear 10 for the right foot and the left foot, depending upon which side faces outward. An advantage to this configuration is that the types of elements that are manufactured for use in different versions of footwear 10 are reduced.

In order to assist with incorporating knitted elements into footwear 10, a registration mark may be knit into the elements. That is, a yarn of different color or a different type of stitch may be knit into the elements to form a registration mark. As an example, element 70 includes a centrally-located registration mark 71, as depicted in FIG. 23. When incorporating element 70 into footwear 10, registration mark 71 may be utilized to ensure that element 70 is centrally-positioned and properly aligned with other elements. Similar registration marks may be utilized for tongue element 40 (i.e., on flanges 47), collar element 50, and collar-throat element 60.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. A method of manufacturing an upper for an article of footwear, the upper having an ankle opening that provides access to a void, the method comprising:

knitting an upper comprising at least an interior surface and an exterior surface adjacent the ankle opening, knitting a collar element comprising a tubular structure defining an interior cavity having a plurality of floating yarns within the cavity, wherein knitting the collar element includes forming a flange that extends outward from the tubular structure, and wherein the flange extends seamlessly outward from a location in which an interior surface and an exterior surface of the collar element are seamlessly joined, and wherein the collar element is formed of unitary knit construction and is formed as a separate component from other portions of the upper, securing the collar element to at least one of the exterior surface and the interior surface of the upper.

2. The method of claim 1 wherein the step of securing includes placing the flange between the interior surface and exterior surface of the upper.

3. The method of claim 1 wherein the flange is secured to at least one of the interior surface and exterior surface of the upper.

* * * * *